US006130697A

United States Patent [19]

Yokoyama et al.

[11] Patent Number: 6,130,697

[45] Date of Patent: Oct. 10, 2000

[54] THERMAL MASTER MAKING DEVICE

[75] Inventors: Yasumitsu Yokoyama; Yoshiyuki Shishido; Satoshi Katoh, all of Kakuda; Yasunobu Kidoura, Shibata-gun, all of Japan

[73] Assignee: Tohoku Ricoh Co., Ltd., Shibata-gun, Japan

[21] Appl. No.: 09/273,273

[22] Filed: Mar. 22, 1999

[30] Foreign Application Priority Data

Jun. 30, 1998 [JP] Japan ..... 10-183997
Dec. 21, 1998 [JP] Japan ..... 10-362544

[51] Int. Cl.[7] ..... B41J 2/32; B41C 1/055; B41L 13/04

[52] U.S. Cl. ..... 347/188; 347/206; 101/128.4

[58] Field of Search ..... 347/206, 188; 101/128.4; 400/120.13

[56] References Cited

U.S. PATENT DOCUMENTS

| | | | |
|---|---|---|---|
| 5,216,951 | 6/1993 | Yokoyama et al. | 347/206 |
| 5,384,585 | 1/1995 | Okumura | 347/206 |
| 5,415,090 | 5/1995 | Natori et al. | 347/206 |
| 5,592,209 | 1/1997 | Hasegawa et al. | 347/206 |
| 5,685,222 | 11/1997 | Yokoyama et al. . | |
| 5,689,297 | 11/1997 | Yokoyama et al. . | |
| 5,809,879 | 9/1998 | Yokoyama et al. . | |

FOREIGN PATENT DOCUMENTS

| | | |
|---|---|---|
| 2-67133 | 3/1990 | Japan . |
| 4-163159 | 6/1992 | Japan . |
| 6-320851 | 11/1994 | Japan . |
| 7-52515 | 2/1995 | Japan . |
| 7-241974 | 9/1995 | Japan . |
| 8-67061 | 3/1996 | Japan . |
| 8-132584 | 5/1996 | Japan . |
| 8-132723 | 5/1996 | Japan . |

*Primary Examiner*—Huan Tran
*Attorney, Agent, or Firm*—Oblon, Spivak, McClelland, Maier & Neustadt, P.C.

[57] ABSTRACT

A thermal master making device includes a thermal head having a plurality of heating elements arranged in an array in the main scanning direction. The thermal head is caused to contact a stencil including a thermoplastic resin film. While the master is fed at a preselected feed pitch in the subscanning direction perpendicular to the main scanning direction, the heating elements selectively heat and perforate the film of the stencil in accordance with image data to thereby form an image in the stencil in the form of a dot pattern. A pitch at which the heating elements are arranged and the feed pitch are substantially equal to each other. The heating elements each have a length in the subscanning direction smaller than one-half of the feed pitch inclusive and have a length in the main scanning direction greater than the length in the subscanning direction. The device is capable of stably forming desired perforations in the stencil and extending the life of the heating element and therefore the life of the head. In addition, the device needs a minimum of master making time and therefore operates at a high speed.

6 Claims, 28 Drawing Sheets

| PULSE WIDTH | HEATING ELEMENT SIZE |
|---|---|
| 500 μs | 20 X 20 μm |
| 500 μs | 20 X 30 μm |
| 500 μs | 30 X 20 μm |
| 500 μs | 30 X 30 μm |
| 1000 μs | 20 X 20 μm |
| 1000 μs | 20 X 30 μm |
| 1000 μs | 30 X 20 μm |
| 1000 μs | 30 X 30 μm |
| 1500 μs | 20 X 20 μm |
| 1500 μs | 20 X 30 μm |
| 1500 μs | 30 X 20 μm |
| 1500 μs | 30 X 30 μm |

| PULSE WIDTH | HEATING ELEMENT SIZE |
|---|---|
| —◆— 500 μs | 20 X 20 μm |
| —■— 500 μs | 20 X 30 μm |
| —▲— 500 μs | 30 X 20 μm |
| —×— 500 μs | 30 X 30 μm |
| ···◆··· 1000 μs | 20 X 20 μm |
| ···■··· 1000 μs | 20 X 30 μm |
| ···▲··· 1000 μs | 30 X 20 μm |
| ···×··· 1000 μs | 30 X 30 μm |
| --◆-- 1500 μs | 20 X 20 μm |
| --■-- 1500 μs | 20 X 30 μm |
| --▲-- 1500 μs | 30 X 20 μm |
| --×-- 1500 μs | 30 X 30 μm |

| HEATING ELEMENT SIZE | PULSE WIDTH |
|---|---|
| ◇ 20 X 20 μm | 500 μs |
| ◈ 20 X 30 μm | 500 μs |
| ◆ 30 X 20 μm | 500 μs |
| ◈ 30 X 30 μm | 500 μs |
| △ 20 X 20 μm | 1000 μs |
| ▲ 20 X 30 μm | 1000 μs |
| ▲ 30 X 20 μm | 1000 μs |
| ▲ 30 X 30 μm | 1000 μs |
| ○ 20 X 20 μm | 1500 μs |
| ⊗ 20 X 30 μm | 1500 μs |
| ● 30 X 20 μm | 1500 μs |
| ⊖ 30 X 30 μm | 1500 μs |

| HEATING ELEMENT SIZE | PULSE WIDTH |
|---|---|
| ◇ 20 X 20 μm | 500 μs |
| ◈ 20 X 30 μm | 500 μs |
| ◆ 30 X 20 μm | 500 μs |
| ◈ 30 X 30 μm | 500 μs |
| △ 20 X 20 μm | 1000 μs |
| ◬ 20 X 30 μm | 1000 μs |
| ▲ 30 X 20 μm | 1000 μs |
| ◬ 30 X 30 μm | 1000 μs |
| ○ 20 X 20 μm | 1500 μs |
| ⊗ 20 X 30 μm | 1500 μs |
| ● 30 X 20 μm | 1500 μs |
| ⊖ 30 X 30 μm | 1500 μs |

| FILM THICKNESS | PULSE WIDTH |
|---|---|
| 1.1 μm | 500 μs |
| 1.1 μm | 1000 μs |
| 1.1 μm | 1500 μs |
| 1.3 μm | 500 μs |
| 1.3 μm | 1000 μs |
| 1.3 μm | 1500 μs |
| 1.5 μm | 500 μs |
| 1.5 μm | 1000 μs |
| 1.5 μm | 1500 μs |
| 1.8 μm | 500 μs |
| 1.8 μm | 1000 μs |
| 1.8 μm | 1500 μs |

ENERGY & DIAMETER IN MAIN SCAN DIRECTION BASED ON FILM THICKNESS

| FILM THICKNESS | PULSE WIDTH |
|---|---|
| 1.1 μm | 500 μs |
| 1.1 μm | 1000 μs |
| 1.1 μm | 1500 μs |
| 1.3 μm | 500 μs |
| 1.3 μm | 1000 μs |
| 1.3 μm | 1500 μs |
| 1.5 μm | 500 μs |
| 1.5 μm | 1000 μs |
| 1.5 μm | 1500 μs |
| 1.8 μm | 500 μs |
| 1.8 μm | 1000 μs |
| 1.8 μm | 1500 μs |

DIAMETER IN MAIN & SUBSCAN DIRECTION
BASED ON FILM THICKNESS

PRINTING PERIOD : 10ms/ℓ

HEATING ELEMENT SIZE : 30 X 20 μm

FILM THICKNESS

*Fig. 28*

TABLE 1

| HEATING ELEMENT SIZE (μm) | PULSE WIDTH (μs) | ENERGY (μJ) | | |
|---|---|---|---|---|
| | | EXP. 1 | EXP. 2 | EXP. 3 |
| 20 X 20 | 500 | 32.5 | 37.5 | 42.5 |
| 20 X 20 | 1000 | 52.5 | 57.5 | 62.5 |
| 20 X 20 | 1500 | 65.0 | 70.0 | 75.0 |
| 20 X 30 | 500 | 37.5 | 42.5 | 47.5 |
| 20 X 30 | 1000 | 57.5 | 62.5 | 67.5 |
| 20 X 30 | 1500 | 75.0 | 80.0 | 85.0 |
| 30 X 20 | 500 | 45.0 | 50.0 | 55.0 |
| 30 X 20 | 1000 | 70.0 | 75.0 | 80.0 |
| 30 X 20 | 1500 | 90.0 | 95.0 | 100.0 |
| 30 X 30 | 500 | 42.5 | 47.5 | 52.5 |
| 30 X 30 | 1000 | 65.0 | 70.0 | 75.0 |
| 30 X 30 | 1500 | 82.5 | 87.5 | 92.5 |

*Fig. 29*

TABLE 2

| HEATING ELEMENT SIZE (μm) | PULSE WIDTH (μs) | ENERGY (μJ) |
|---|---|---|
| 20 X 20 | 500 | 43.5 |
| 20 X 20 | 1000 | 57.5 |
| 20 X 20 | 1500 | 72.0 |
| 20 X 30 | 500 | 49.0 |
| 20 X 30 | 1000 | 63.5 |
| 20 X 30 | 1500 | 80.0 |
| 30 X 20 | 500 | 57.0 |
| 30 X 20 | 1000 | 75.5 |
| 30 X 20 | 1500 | 93.5 |
| 30 X 30 | 500 | 54.0 |
| 30 X 30 | 1000 | 70.0 |
| 30 X 30 | 1500 | 85.0 |

*Fig. 30*

TABLE 3

| PULSE WIDTH A (μs) | PRINTING PERIOD CAUSING GREAT CHANGE B (μs/1) | A/B X100 (%) | DISTANCE OF CONVEYANCE (μm) |
|---|---|---|---|
| 500 | 1500 | 33 | 21.2 |
| 1000 | 3000 | 33 | 21.2 |
| 1500 | 4500 | 38 | 23.8 |

THERMAL MASTER MAKING DEVICE

BACKGROUND OF THE INVENTION

The present invention relates to a thermal master making device for making a master out of a thermosensitive stencil with a thermal head. More particularly, the present invention is concerned with a thermal master making device capable of stably perforating a stencil at a high speed and extending the life of heating elements included in a thermal head.

A thermal master making device is included in, e.g. a thermal stencil printer. Various technologies including one for obviating so-called offset have been proposed for a thermal master making device. The technology for obviating offset is taught in, e.g., Japanese Patent Laid-Open Publication No. 2-67133 corresponding to Japanese Patent No. 2,732,532. Also, Japanese Patent Laid-Open Publication No. 8-67061, for example, discloses a technology using a thermal head similar in configuration to a thermal head included in the present invention, and controlling the diameter of perforations to be formed in a thermoplastic resin film included in a stencil in such a manner as to form an optimal image. Further, Japanese Patent Laid-Open Publication No. 8-132584 proposes a technology for reducing a master making time.

However, the above conventional technologies have some problems left unsolved, as follows. Neither Laid-Open Publication No. 2-67133 nor Laid-Open Publication No. 8-67061 gives consideration to the increasing demand for the reduction of a master making time. Moreover, Laid-Open Publication No. 8-67061 basically proposes the configuration of a heating element for making resolution in the subscanning direction variable and is therefore different in object from the present invention. Although Laid-Open Publication No. 8-132584 is directed toward a short master making time, it cannot implement the further reduction of a master making time required of advanced master making devices.

Technologies relating to the present invention are also disclosed in, e.g., Japanese Patent Laid-Open Publication Nos. 4-163159, 6-320851, 7-52515, 7-241974 and 8-132723, U.S. Pat. Nos. 5,689,297, 5,685,222 and 5,809,879, and pending U.S. patent application Ser. No. 08/986,636 field Dec. 8, 1997.

SUMMARY OF THE INVENTION

It is therefore an object of the present invention to provide a thermal master making device capable of stably forming desired perforations in a stencil with a thermal head.

It is another object of the present invention to provide a thermal master making device capable of increasing the life of heating elements included in a thermal head and therefore the life of the thermal head.

It is a further object of the present invention to provide a thermal master making device operable with a minimum of master making time and therefore at a high speed.

In accordance with the present invention, in a thermal master making device including a thermal head having a plurality of heating elements arranged in an array in the main scanning direction, causing the head to contact a stencil including a thermoplastic resin film, feeding the master at a preselected feed pitch in the subscanning direction perpendicular to the main scanning direction, and causing the heating elements to selectively heat to perforate the film in accordance with image data for thereby forming an image in the stencil in the form of a dot pattern, a pitch at which the heating elements are arranged and the feed pitch are substantially equal to each other. The heating elements each have a length in the subscanning direction smaller than one-half of the feed pitch inclusive and have a length in the main scanning direction greater than the length in the subscanning direction.

In a preferred embodiment, a pulse width for causing the heating elements to heat, a printing period assigned to the head and the feed pitch satisfy a relation:

$$[\text{pulse width}(\mu s) \div \text{printing period}(\mu s/\text{line})] \times \text{feed pitch}(\mu m/\text{line}) \geqq 25(\mu m)$$

In another preferred embodiment, the above pulse, printing period and feed pitch satisfy a relation:

$$[\text{pulse width}(\mu s) \div \text{printing period}(\mu s/\text{line})] \times \text{feed pitch}(\mu m/\text{line}) \leqq 25(\mu m)$$

BRIEF DESCRIPTION OF THE DRAWINGS

The above and other objects, features and advantages of the present invention will become more apparent from the following detailed description taken with the accompanying drawings in which:

FIG. 28 shows Table 1 listing energy to be applied to the individual heating element under various conditions;

FIG. 29 shows Table 2 listing energy to be applied to the individual heating element in relation to the heating element size and pulse width; and FIG. 30 shows Table 3 representative of a relation between the printing period, the pulse width and a distance by which a stencil is conveyed over the pulse width.

DESCRIPTION OF THE PREFERRED EMBODIMENTS

Figure 1:
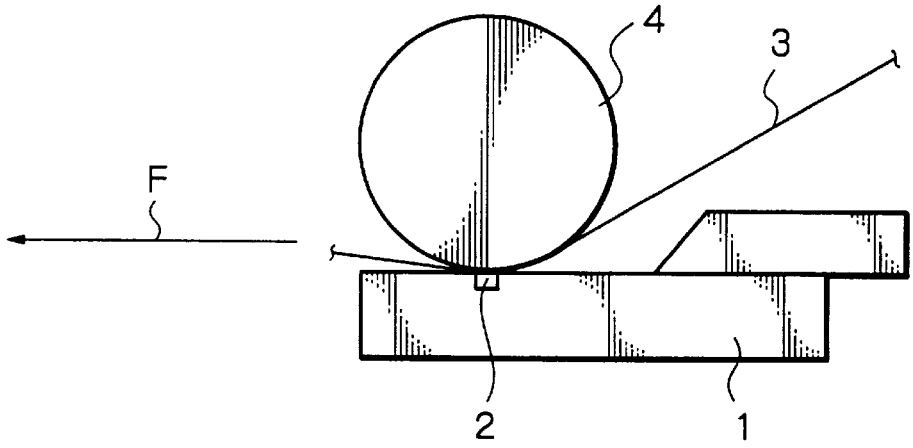
FIG. 1 is a front view showing the general construction of a thermal master making device in accordance with the present invention.

Preferred embodiments of the thermal master making device in accordance with the present invention will be described hereinafter. In the illustrative embodiments, parts and elements identical in function or configuration are designated by like reference numerals, and a redundant description thereof will not be made as far as possible. As for parts and elements provided in pairs and not needing distinction, only one of them will be described.

First, a relation between energy to be applied to heating elements included in a thermal head and the perforation of a stencil will be described.

FIG. 1 shows the essential arrangement of the master making device in accordance with the present invention. As shown, a thermal head 1 includes a plurality of heating elements 2 (only one is visible) arranged in an array in the main scanning direction (perpendicular to the sheet surface of FIG. 2). A stencil 3 including a thermoplastic resin film is held between the thermal head 1 and a platen roller 4 by a pressing mechanism not shown. The platen roller 4 in rotation conveys the stencil 3 in the subscanning direction (coincident with a direction of stencil conveyance) perpendicular to the above main scanning direction, as indicated by an arrow in FIG. 1. The conveyance is effected by a preselected pitch at a time. A head driver including electric and electronic control circuitry controls the head 1 in accordance with image data in synchronism with the above conveyance of the stencil 3. As a result, the heating elements 2 are selectively energized to perforate the film of the stencil 3. Such an energization cycle is repeated in synchronism with the pitch of stencil conveyance, forming an image in the stencil 3 in the form of a perforation pattern.

Electric energy for causing the individual heating element 2 to generate heat is determined by a resistance R particular to the heating element 2, power to be applied to the heating element 2, and a pulse width tp over which the power P is continuously applied. The pulse width will sometimes referred to as a duration of power feed hereinafter.

The power P is expressed as:

$$P(W)=E^2(V)/R$$

where E denotes a voltage applied to the heating element 2. It is to be noted that a line is labeled "/" in graphs to be described later.

Energy Es to be applied to the heating element 2 is produced by:

$$Es(J)=P(W)\times tp(s)$$

That is, the energy Es is determined by the power P applied to the heating element 2 and the pulse width or duration of power feed tp.

FIRST EMBODIMENT

Experiments were conducted to determine, taking account of the temperature of the individual heating element 2, how the stencil 3 was perforated when the configuration of the heating element 2 and the energy Es were varied. The power P, pulse width tp and energy Es will be described in relation to a single heating element 2. For the experiments, the following conditions were selected.

(1) Configuration of Head 1

The head 1 was a so-called line type thermal head having an array of heating elements 2 extending in the main scanning direction S. The individual heating element 2 had a rectangular shape. The head 1 had a resolution of 400 dpi (dots per inch) for size A3 and had 4,608 heating elements 2 arranged in the main scanning direction S at a pitch As of 63.5 μm (see FIG. 26).

Figure 26:
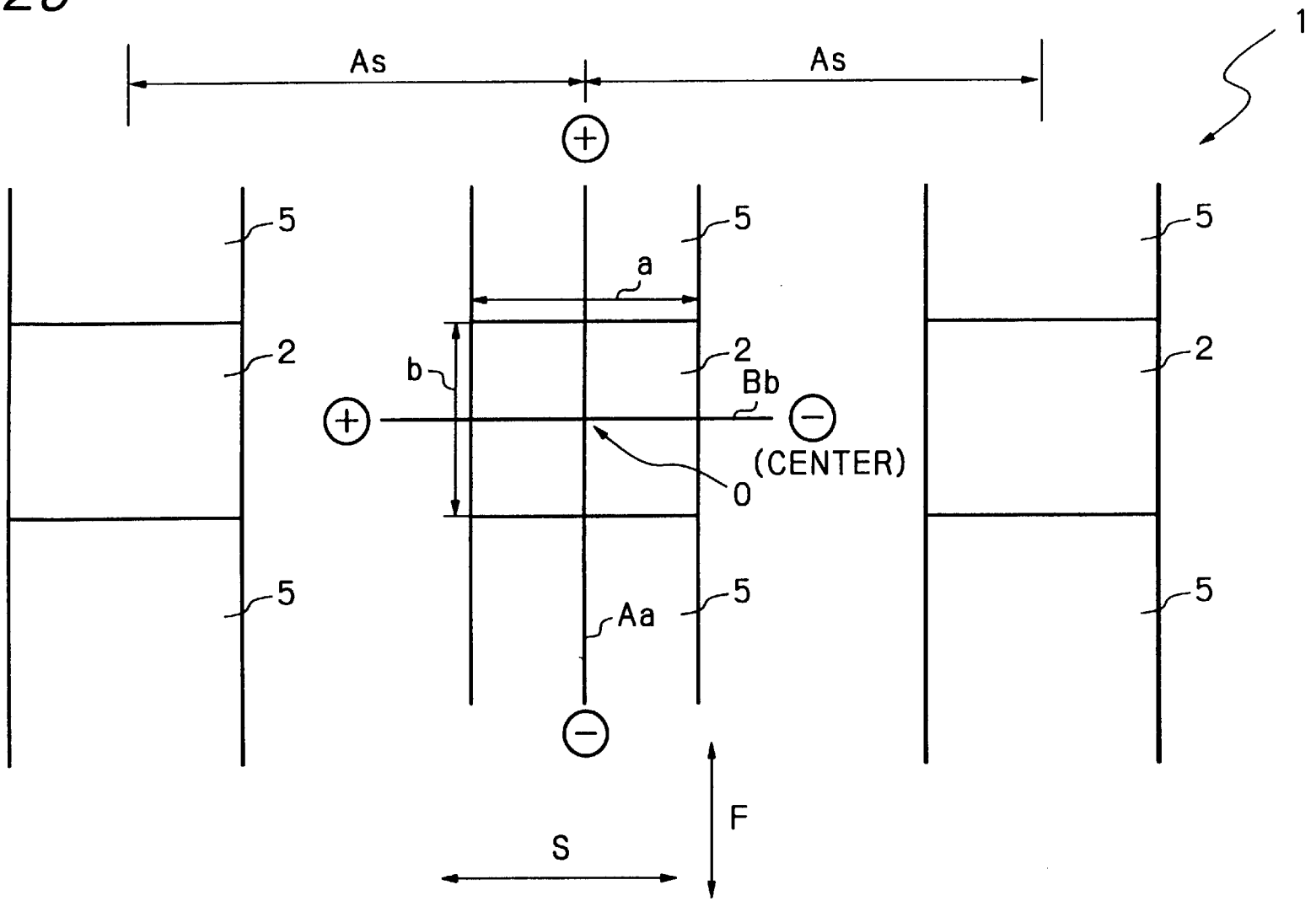
FIG. 26 is an enlarged plan view showing the heating elements, as seen through a protection film in order to indicate positions on the individual heating element in the main and subscanning directions.

There were prepared four thermal heads 1 each having heating elements 2 of particular shape or size, as follows. As shown in FIG. 26, while each heating element 2 has a size represented by a length a in the main scanning direction S and a length b in the subscanning direction F, the size will be simply referred to as a size (main scanning×subscanning) hereinafter in order to omit the labels a and b. Four different sizes of the heating elements 2 (main scanning× subscanning) are as follows:

main scanning×subscanning: 20×20 μm main scanning×subscanning: 20×30 μm main scanning×subscanning: 30×20 μm main scanning×subscanning: 30×30 μm (2) Duration of Power Feed to Heating Element 2

Pulses to be applied to the heating element 2 had three stepwise widths tp of 500 μs, 1,000 μs, and 1,500 μs.

(3) Pitch pf of Stencil Conveyance in Subscanning Direction

The stencil 3 was conveyed by a pitch pf of 63.5 m/line in the subscanning direction for the resolution of 400 dpi. In the illustrative embodiment, the pitch As in the main scanning direction and the pitch pf in the subscanning direction are assumed to be substantially equal to each other. However, when the pitch pf should be matched to, e.g., the document reading pitch of a scanner in the subscanning direction, the pitch pf may be selected within the range of ±5% of the pitch As, e.g., 63.5±3.2 μm. Therefore, the fact that the pitches As and pf are substantially the same includes such an extra case.

(4) Printing Period t1 and Drive System

Printing was effected at a period t1 of 10 ms/line by a quadruple drive system. The head 1 was held at a temperature of 25° C.

(5) Stencil 3

The stencil 3 was implemented by an about 41.6 μm thick stencil VT-II A3 (trade name) available from Ricoh Co., Ltd. and made up of an about 40 μm thick base and a 1.6 μm film adhered together. The base was a mixture of polyester or similar synthetic fibers and Japanese paper fibers belonging to a family of natural fibers.

(6) Platen Roller 4

The platen roller 4 was formed of silicone rubber with carbon added thereto and provided with conductivity. The silicone rubber had a rubber hardness of 43° Hz (Scale A prescribed by JIS (Japanese Industrial Standards) and a volume resistivity of $10^3\pm10^2$ cm. The roller 4 included a core formed of SUM or similar metal and having a wall thickness of 2 mm and an outside diameter of 18 mm. A pressure to act between the roller 4 and the head 1 via the stencil 3 was selected to be 4.04 N/cm. The roller 4 is driven by, e.g., a stepping motor not shown.

(7) Thermal Master Making Device

As for the thermal master making device, use was made of a plotter unit mounted on a digital stencil printer Priport VT-3820 (trade name) also available from Ricoh Co., Ltd.

Figure 2:
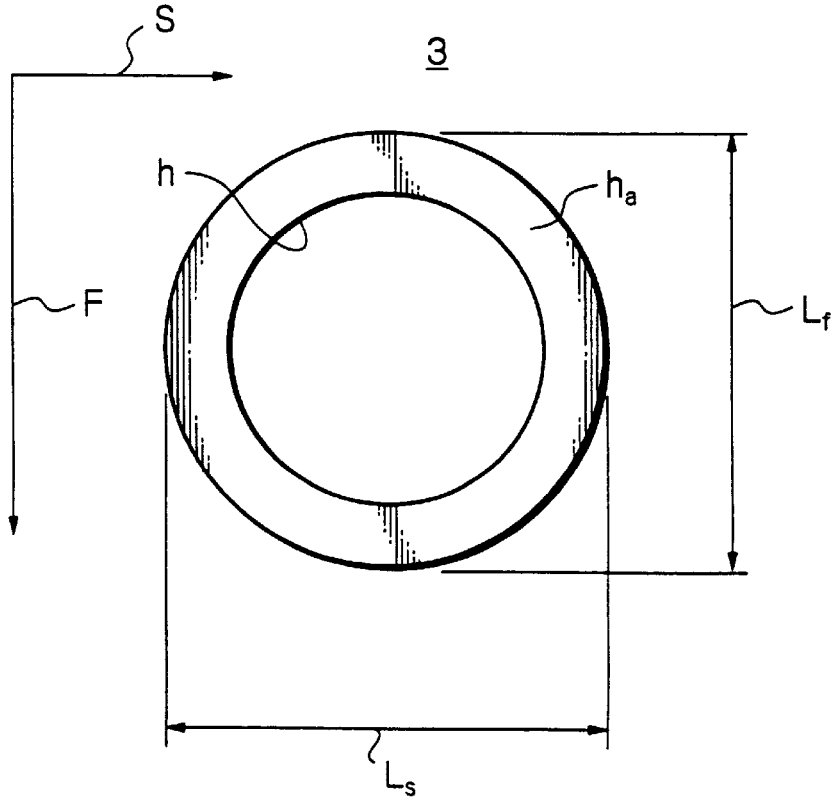
FIG. 2 is a plan view showing various dimensions including the diameters of a perforation formed in a stencil by the device of FIG. 1.

Let a perforation pattern formed in the stencil 3 and the diameters of the individual perforation be defined, as follows. FIG. 2 shows a perforation h formed in the stencil 3 and a substantially annular bank ha formed around the perforation h due to the shrinkage of the film of the master 3. The bank ha has a maximum outside diameter Ls in the main scanning direction S and a maximum outside diameter Lf in the subscanning direction F. Experiments which will be described hereinafter showed that the bank ha had a width of about 5 μm.

Figure 3:
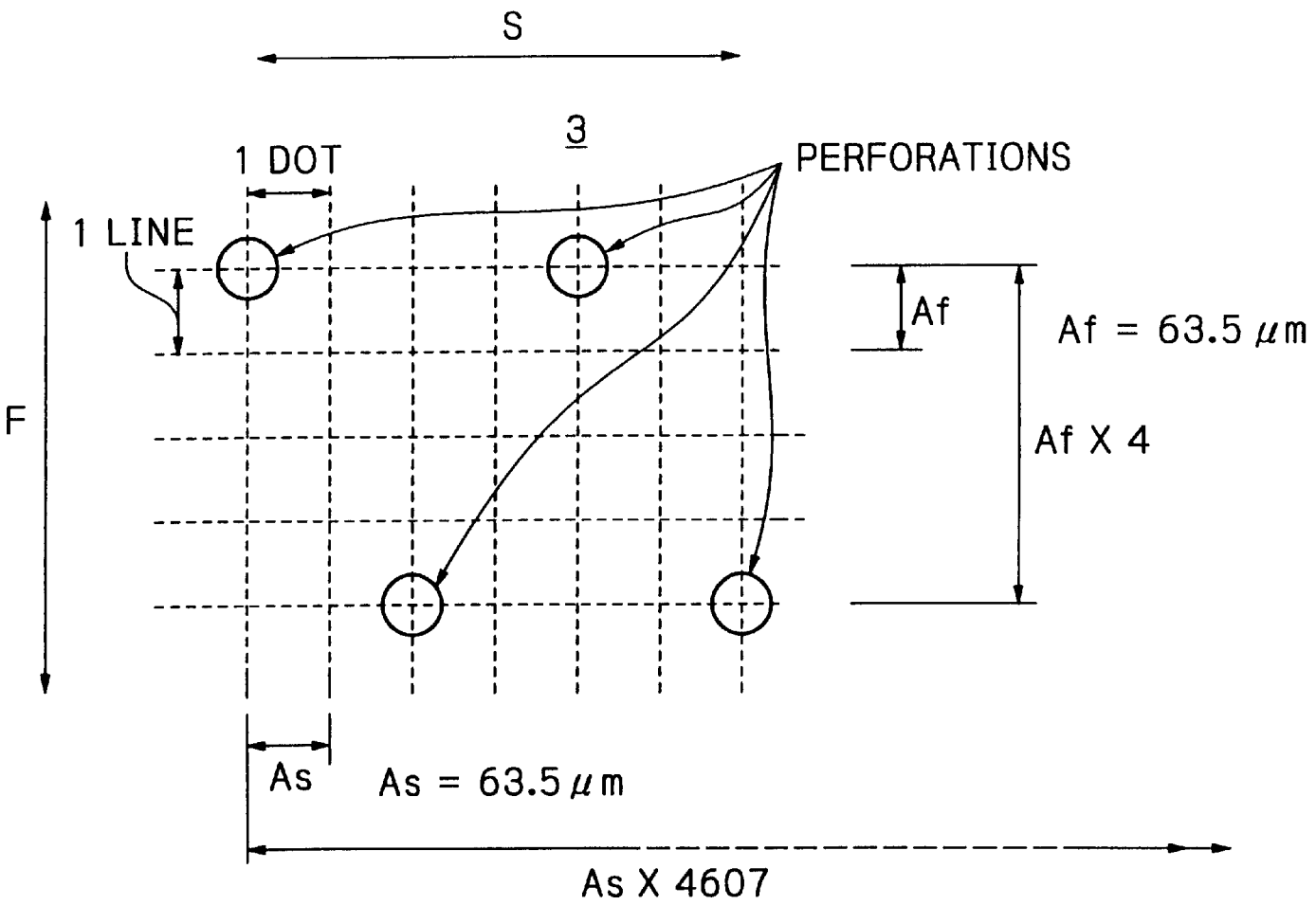
FIG. 3 is a plan view showing a specific perforation pattern formed in a thermoplastic resin film included in the stencil.

FIG. 3 shows a specific one-dot checker pattern formed in the film of the stencil 3 by the heating elements 2 thermally isolated from each other. As shown, dots were formed every fourth dot in the main scanning direction S and every fourth line in the subscanning direction F. The pitch As in the main scanning direction was selected to be 63.5 μm for the resolution of 400 dpi. A pitch Af in the subscanning direction was also selected to be 63.5 μm. That is, the pitch As in the main scanning direction and the feed pitch or pitch of conveyance pf in the subscanning direction both are 63.5 μm.

The fact that the head 1 has 4,608 heating elements 2 in the main scanning direction S indicates that a range of 63.5×4,607 μm which can be perforated was available with the master 3. As for the diameters of the perforation h, the diameters of fifty particular perforations were measured in the main scanning direction and subscanning direction and then averaged to determine the diameters Ls and Lf.

Pulses having three different pulse widths tp of 500 μs, 1,000 μs and 1,500 μs were applied to the head 1 having the heating elements 2 provided with any one of the four different sizes. The diameters Ls and Lf of the resulting perforations h formed in the film of the stencil 3 were measured by use of an optical microscope and an image processing device. Data relating to the diameters Ls and Lf shown in all the drawings were measured via an optical microscope and an image processing device.

Figure 4:
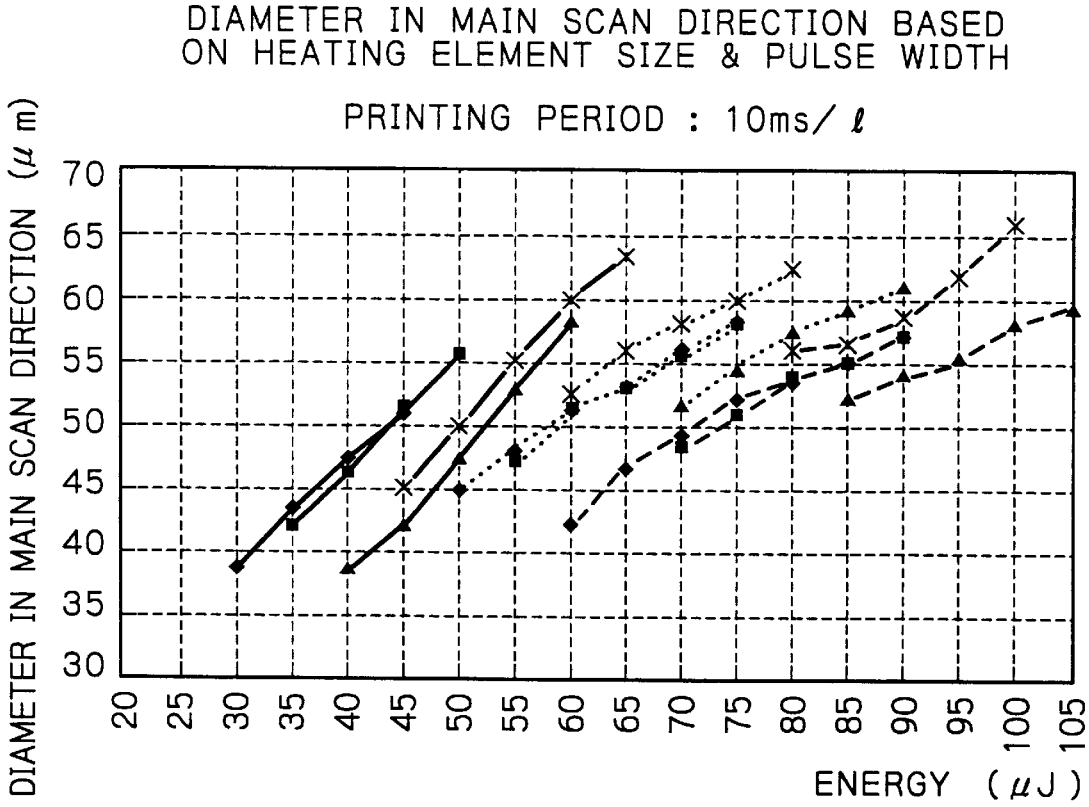
FIG. 4 is a graph showing, by using the heating element size of a thermal head and pulse width as parameters, a relation between the size of energy applied to a heating element and the diameter of the resulting perforation in the main scanning direction and representative of a first embodiment of the present invention.
Figure 5:
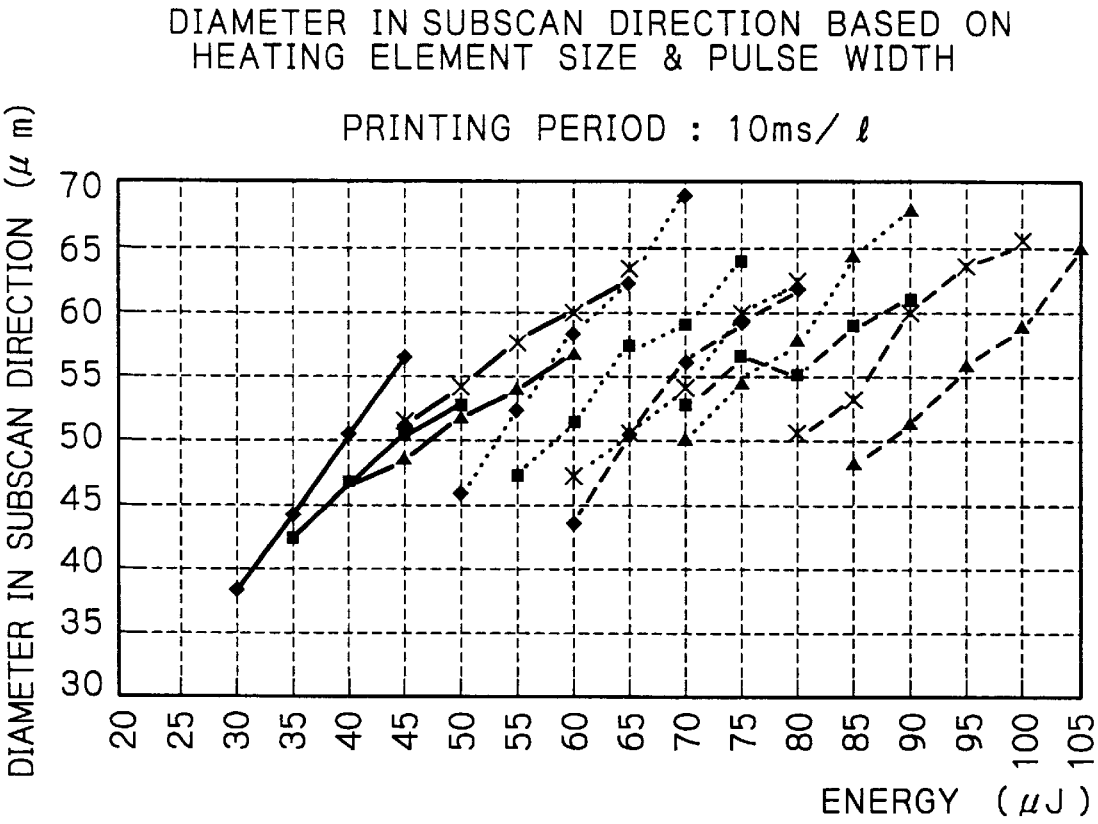
FIG. 5 is a graph similar to FIG. 4, showing a relation between the size of energy and the diameter of a perforation in the subscanning direction.

FIG. 4 shows a relation between the energy Es applied to the individual heating element 2 and the diameter Ls of the resulting perforation in the main scanning direction with respect to the four different sizes of the element 2 and the three different pulse widths tp. In FIG. 4, the abscissa and ordinate indicate the energy Es and perforation diameter Ls, respectively. FIG. 5 shows a relation between the energy Es and the diameter Lf in the subscanning direction Lf; the abscissa and ordinate also indicate the energy Es and perforation diameter Ls, respectively. Should the pulse width tp be short, it would eventually reduce the life of the head 1, as will be described specifically later. In light of this, in FIGS. 4 and 5, only four data were produced with the heating elements 2 sized 20×20 μm (main scanning×subscanning) and 20×30 μm and pulse width tp of 500 μs.

As FIGS. 4 and 5 indicate, perforations h with the same diameters Ls and Lf in the main and subscanning directions, respectively, are achievable with the heads 1 different in heating element size without regard to the pulse width tp. This can be done if the power P and therefore energy Es to be applied to the heating element 2 is adequately adjusted.

Figure 6:
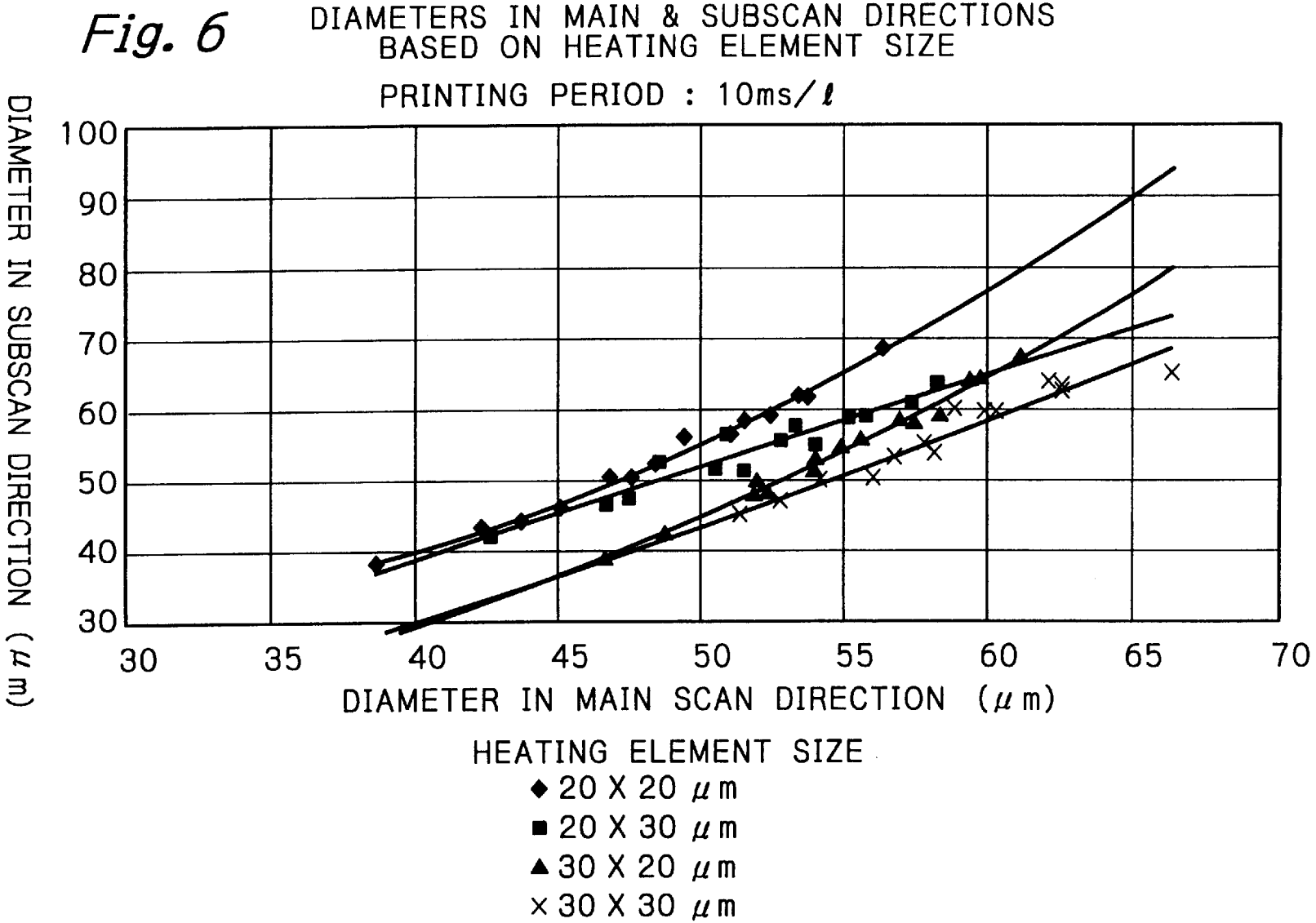
FIG. 6 is a graph showing, based on the data of FIGS. 4 and 5, a relation between the diameter in the main scanning direction and the diameter in the subscanning direction by using the size of a heating element as a parameter.

FIG. 6 shows, based on the data of FIGS. 4 and 5, a relation of the diameter Lf in the subscanning direction to the diameter Ls in the main scanning direction with respect to the four different sizes of the heating element 2. In FIG. 6, the abscissa and ordinate indicate the diameters Ls and Lf, respectively. As FIG. 6 indicates, for a given diameter Ls in the main scanning direction, the diameter Lf in the subscanning direction is almost unconditionally determined by the size of the heating element 1. Stated another way, for a given diameter Ls, the diameter Lf is not dependent on the pulse width tp.

SECOND EMBODIMENT

Again, pulses having the three different pulse widths tp of 500 μs, 1,000 μs and 1,500 μs were applied to the head 1 with the heating elements 2 having any one of the four different sizes. A relation between the diameter Ls or Lf of the resulting perforations and the peak temperature of the heating elements 2 was determined, as follows. To measure the peak temperature of the heating elements 2, use was made of an infrared microscope type radiothermometer RM-2AS (trade name) available from Nippon Barns Co., Ltd. FIG. 28 shows Table 1 listing energy Es applied to the heating elements 2 under various conditions.

Figure 7:
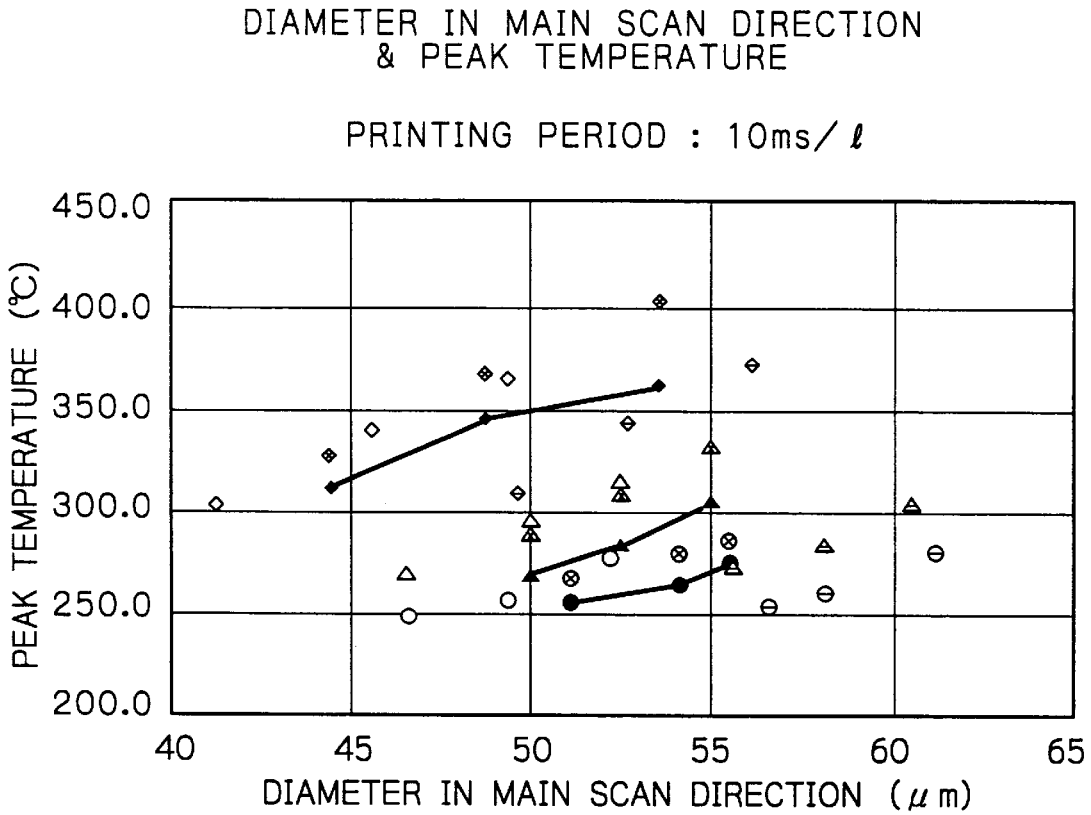
FIG. 7 is a graph showing, by using the heating element size of a thermal head and pulse width as parameters, a relation between the diameter of a perforation in the main scanning direction and the peak temperature of a heating element and representative of a second embodiment of the present invention.
Figure 8:
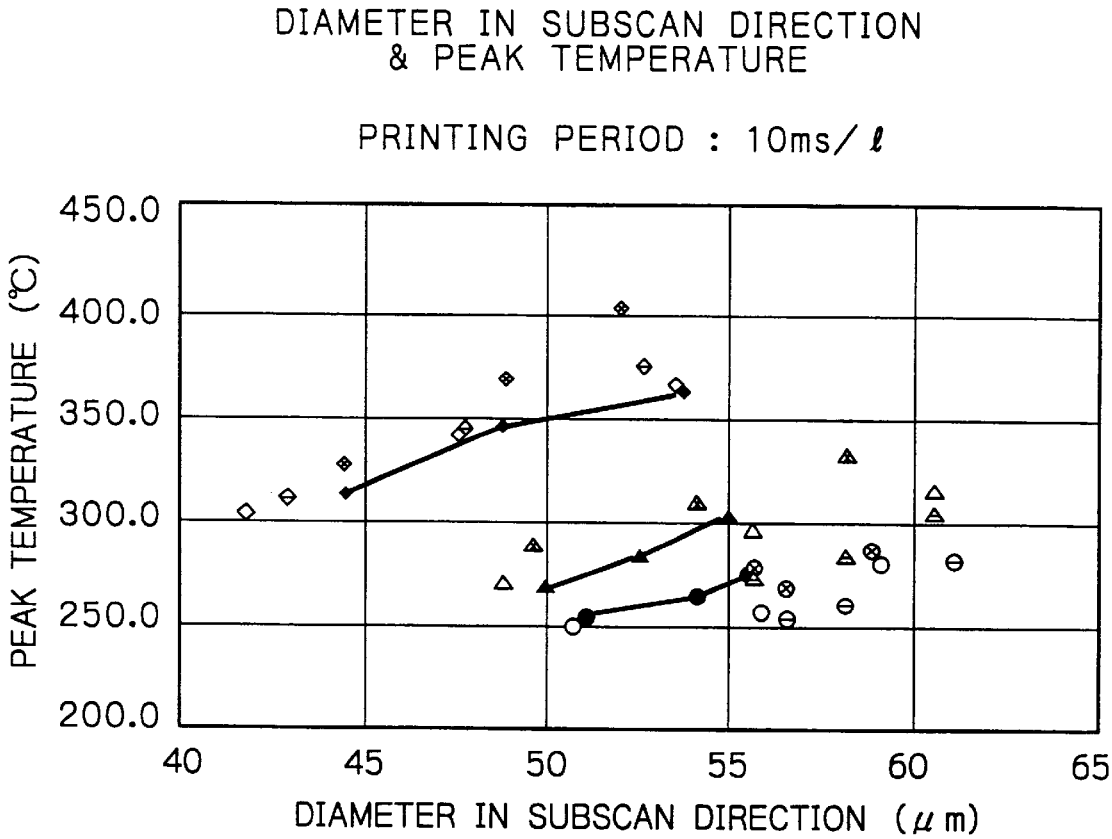
FIG. 8 is a graph similar to FIG. 7, showing a relation between the diameter of the perforation in the subscanning direction and the peak temperature.

FIGS. 7 and 8 respectively show a relation between the diameter Ls in the subscanning direction and the peak temperature of the heating elements 1 and a relation between the diameter Lf in the subscanning direction and the peak temperature, as determined by experiments. For the experiments, the size of the heating element 2 and pulse widths tp were used as parameters. In FIG. 7, the abscissa and ordinate respectively indicate the diameter Ls and peak temperature while, in FIG. 8, the abscissa and ordinate respectively indicate the diameter Lf and peak temperature.

Figure 9:
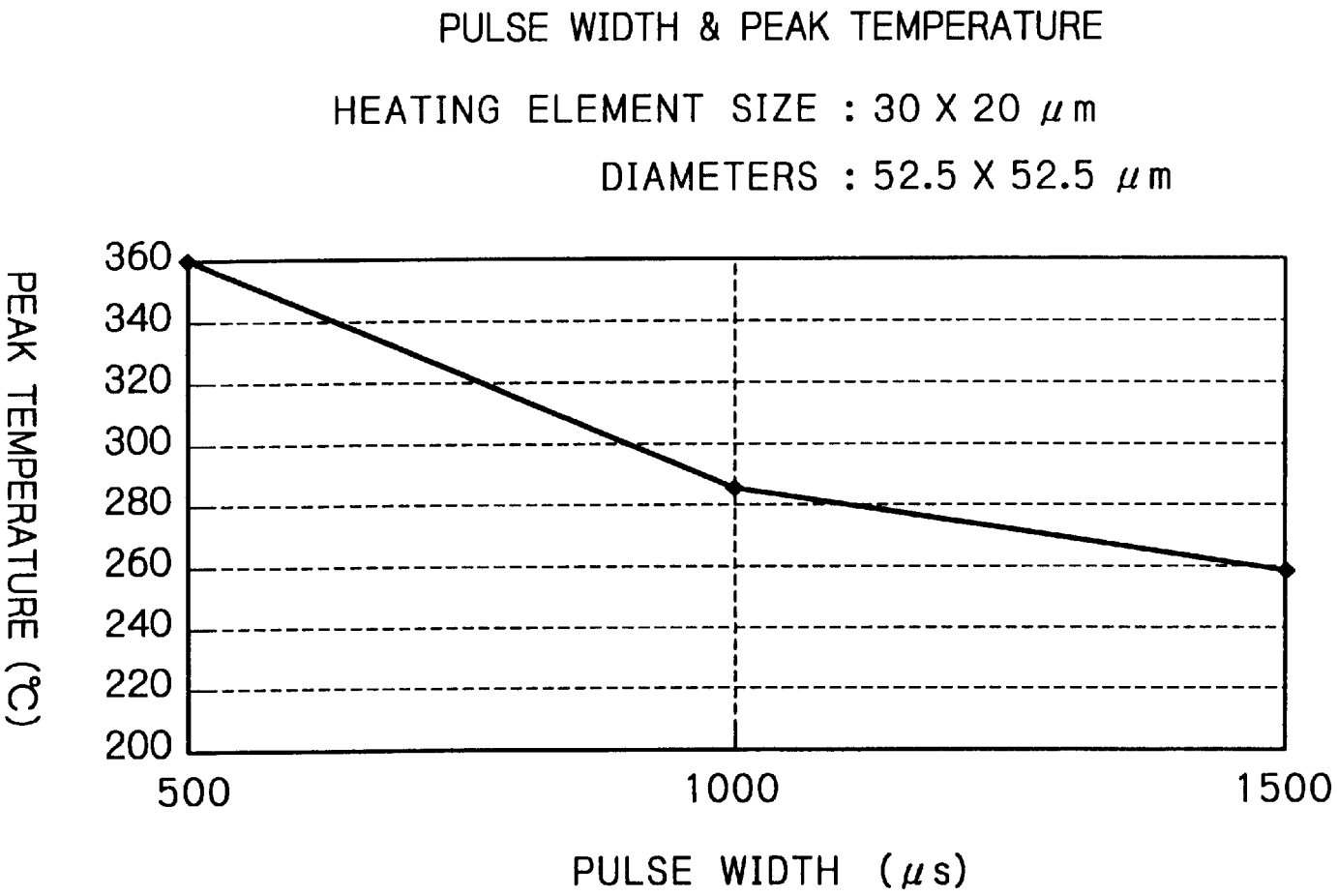
FIG. 9 is a graph showing, based on the data shown in FIGS. 7 and 8, a relation between the pulse width and the peak temperature of a heating element determined when the heating element size was 30 (main scanning direction)×20 (subscanning direction) $\mu$m and a perforation had a diameter of 52.5 $\mu$m in both of the main scanning and subscanning directions.

As shown in FIGS. 7 and 8, assume the heating element 2 sized 30×20 μm (main scanning×subscanning), the pulse widths tp of 500 μs, 1,000 μs and 1,500 μs, the diameter Ls of 52.5 μm, and the diameter Lf of 52.5 μm. Then, the head 1 has a peak temperature of 360° C. for the pulse width tp of 500 μs, a peak temperature of about 285° C. for the pulse width tp of 1,000 μs, and a peak temperature of 260° C. for the pulse width tp of 1,500 μs. It will therefore be seen that the peak temperature of the heating element 2 increases with a decrease in pulse width tp. Such a relation between the pulse width tp and the peak temperature is shown in FIG. 9 and also holds with the other heads 2. The life of the head 1 is noticeably dependent on its peak temperature, i.e., a thermal stress to act on the head 1 increases with an increase in temperature and reduces the life of the head 1, as well known in the art.

THIRD EMBODIMENT

The experiments of the first embodiment were conducted under the same conditions except for the following.

(1) Head 1 and Heating Element 2

Two different heads 1 having heating elements 2 sized 20×30 μm and 30×20 μm (main scanning×subscanning), respectively, were used.

(2) Stencil 3

Four different kinds of stencils 3 which were 1.1 μm, 1.3 μm, 1.5 μm and 1.8 μm thick, respectively, were used. As for the other configuration, the stencils 3 were identical with the stencil of the first embodiment.

Figure 10:
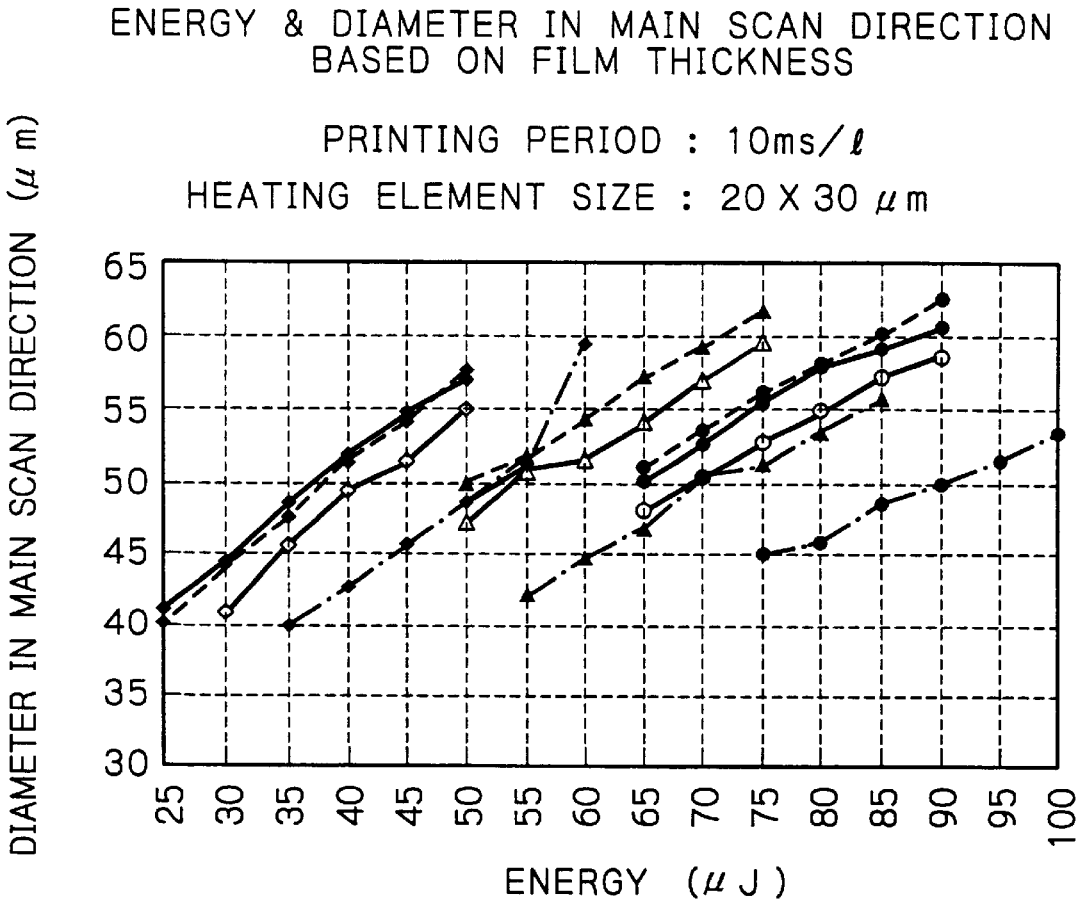
FIG. 10 is a graph showing, by using the thickness of the film and pulse width as parameters, a relation between the size of energy and the diameter in the main scanning direction determined when the heating element size was 20×30 μm.
Figure 11:
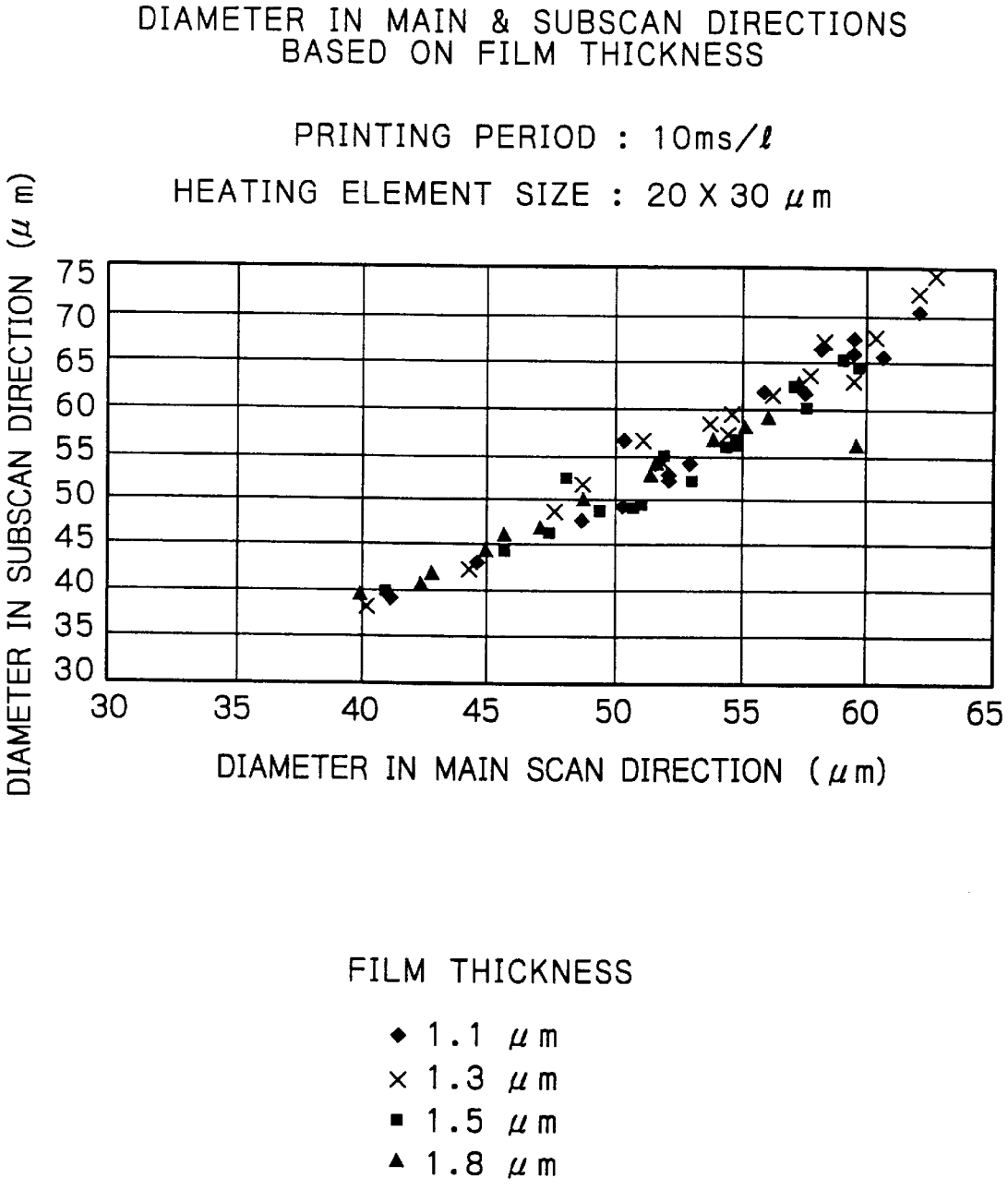
FIG. 11 is a graph showing a relation between the diameter in the main scanning direction and the diameter in the subscanning direction as to all the data shown in FIG. 10.

FIG. 10 shows a relation between the energy Es and the diameter Ls in the main scanning direction determined only with the head 1 whose heating elements were sized 20×30 μm and by varying the film thickness of the stencil 3 and pulse width tp. In FIG. 10, the abscissa and ordinate indicate the energy Es and diameter Ls, respectively. FIG. 11 shows a relation between the diameters Ls and Lf in relation to all the data shown in FIG. 10.

As FIGS. 10 and 11 indicate, to form perforations of the same diameter Ls or Lf, the energy Es must be increased with an increase in the thickness of the film of the stencil 3. However, the diameters Lf in the subscanning direction are plotted on substantially straight lines in relation to the diameters Ls in the main scanning line, i.e., the former is substantially proportional to the latter. This means that the diameters Ls and Lf are unconditionally determined by the energy Es. Stated another way, the above relation between the energy Es and the diameters Ls and Lf holds without regard to the film thickness of the stencil 3.

Figure 12:
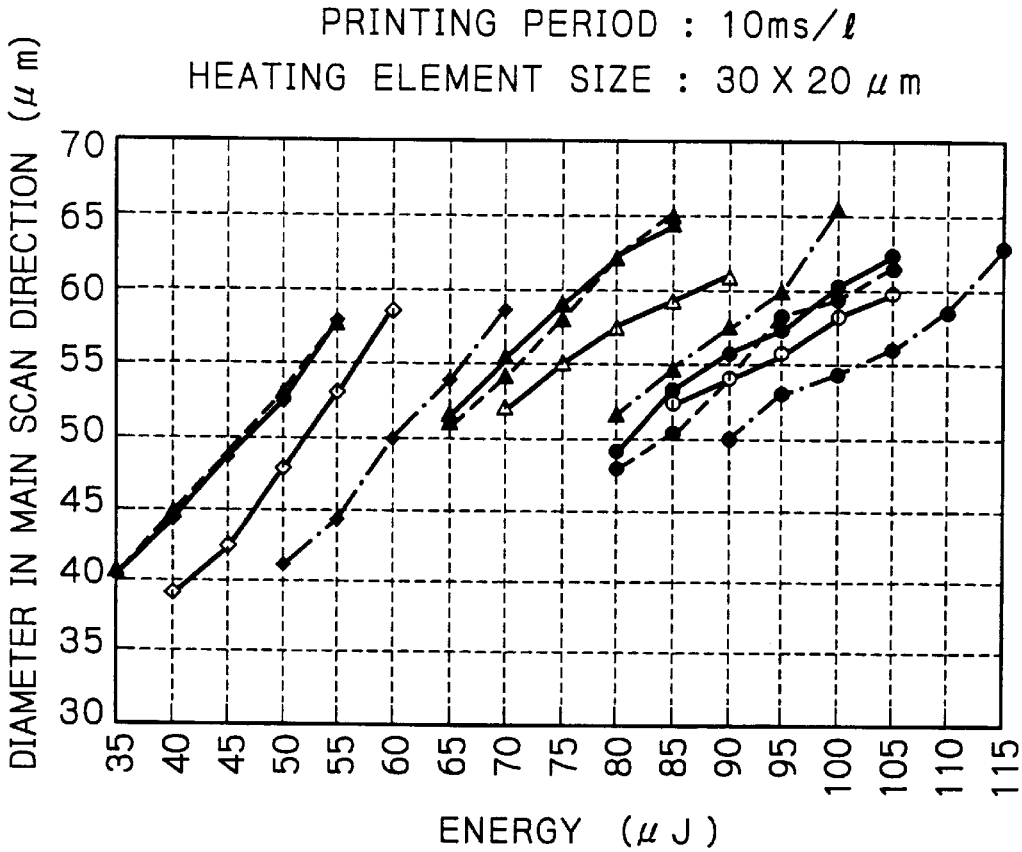
FIG. 12 is a graph showing, by using the thickness of the film and pulse width as parameters, a relation between the size of energy and the diameter in the main scanning direction determined when the heating element size was 30×20 μm and representative of a third embodiment of the present invention.
Figure 13:
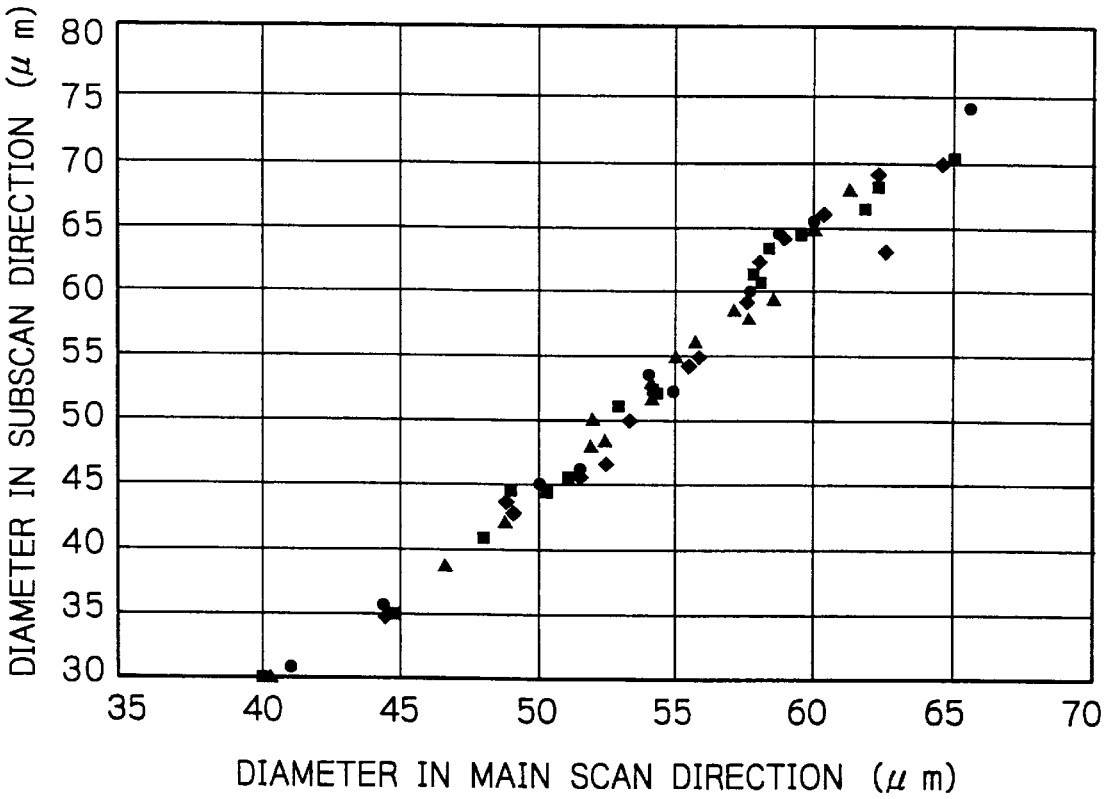
FIG. 13 is a graph showing a relation between the diameter in the main scanning direction and the diameter in the subscanning direction as to all the data shown in FIG. 12.

The above experiments were repeated with the other head 1 whose heating elements 2 were sized 30×20 μm. FIG. 12 shows the results of such experiments. FIG. 13 shows a relation between the diameters Ls and Lf in relation to all the data shown in FIG. 12. FIGS. 12 and 13 prove the same relation as stated above with reference to FIGS. 10 and 11.

FOURTH EMBODIMENT

Reference will be made to FIGS. 14–19 for describing a relation between the diameters Ls and Lf and the printing period t1 and pulse width tp determined by using the size of the heating element 2 as a parameter. As shown, the printing period t1 was varied in six consecutive steps to 1, 1.5, 2, 3, 5 and 10 ms/line while the pulse width tp was varied in three consecutive steps to 500, 1,000 and 1,500 μm. In FIGS. 14–19, the printing period t1 is represented by a master making speed.

In FIGS. 14–19, to clear up the influence of the printing period t1 on the diameters Ls and Lf, the power P to be applied to the heating element 2 was preselected for each heating element size and each pulse width tp such that the diameter Lf in the subscanning direction converged to 55 μm at the printing period of t1 of 10 ms/line. The feed pitch pf in the subscanning direction was selected to be 400 dpi (63.5 μm).

FIG. 29 shows Table 2 listing the energy Es applied to the heating element 2 for each of the pulse widths tp. The experimental results shown in FIGS. 14–19 are based on the conditions of Table 2.

Figure 14:
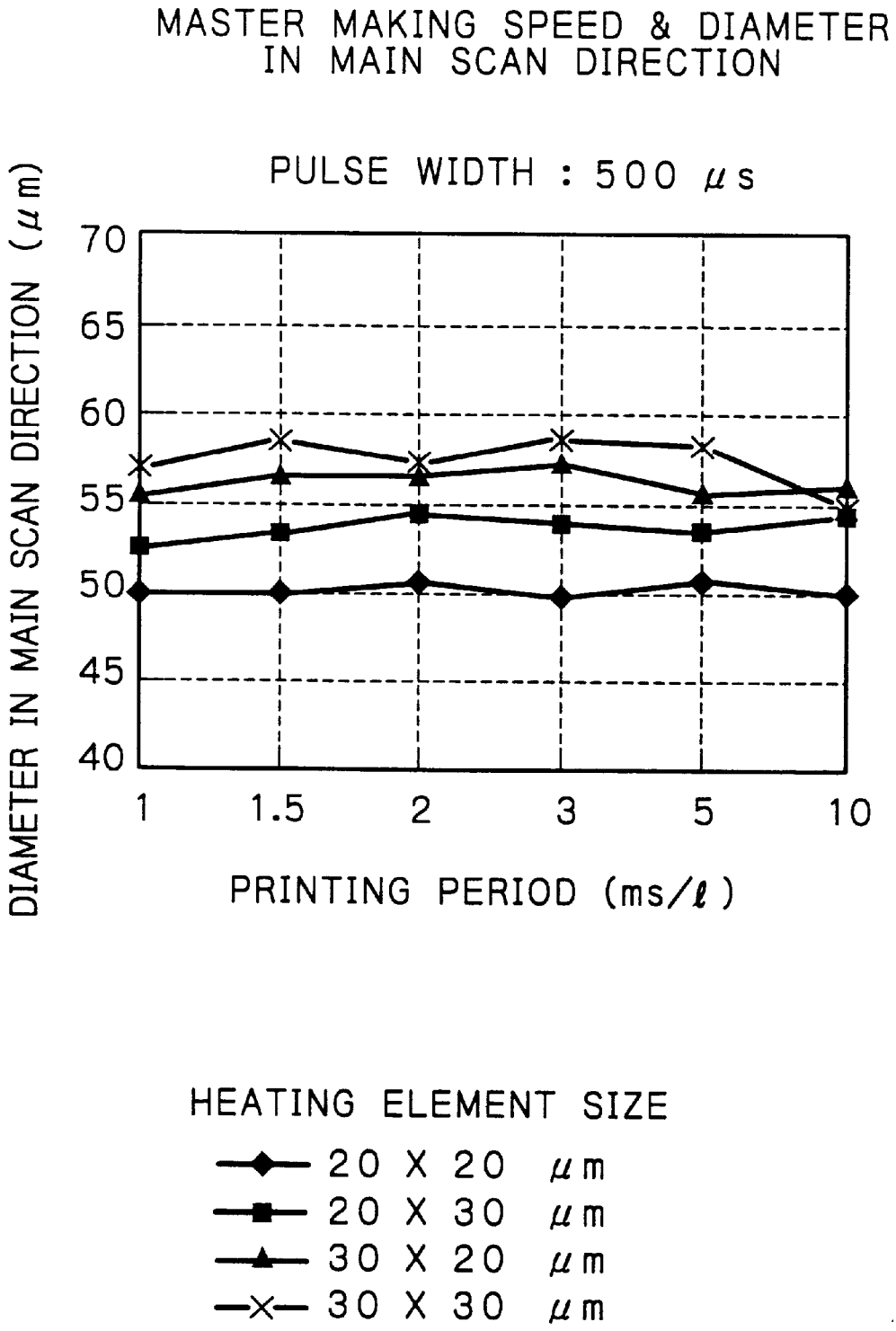
FIG. 14 is a graph showing, by using the heating element size as a parameter, a relation between a printing period and the diameter in the main scanning direction determined when the pulse width was 500 μs and representative of a fourth embodiment of the present invention.
Figure 15:
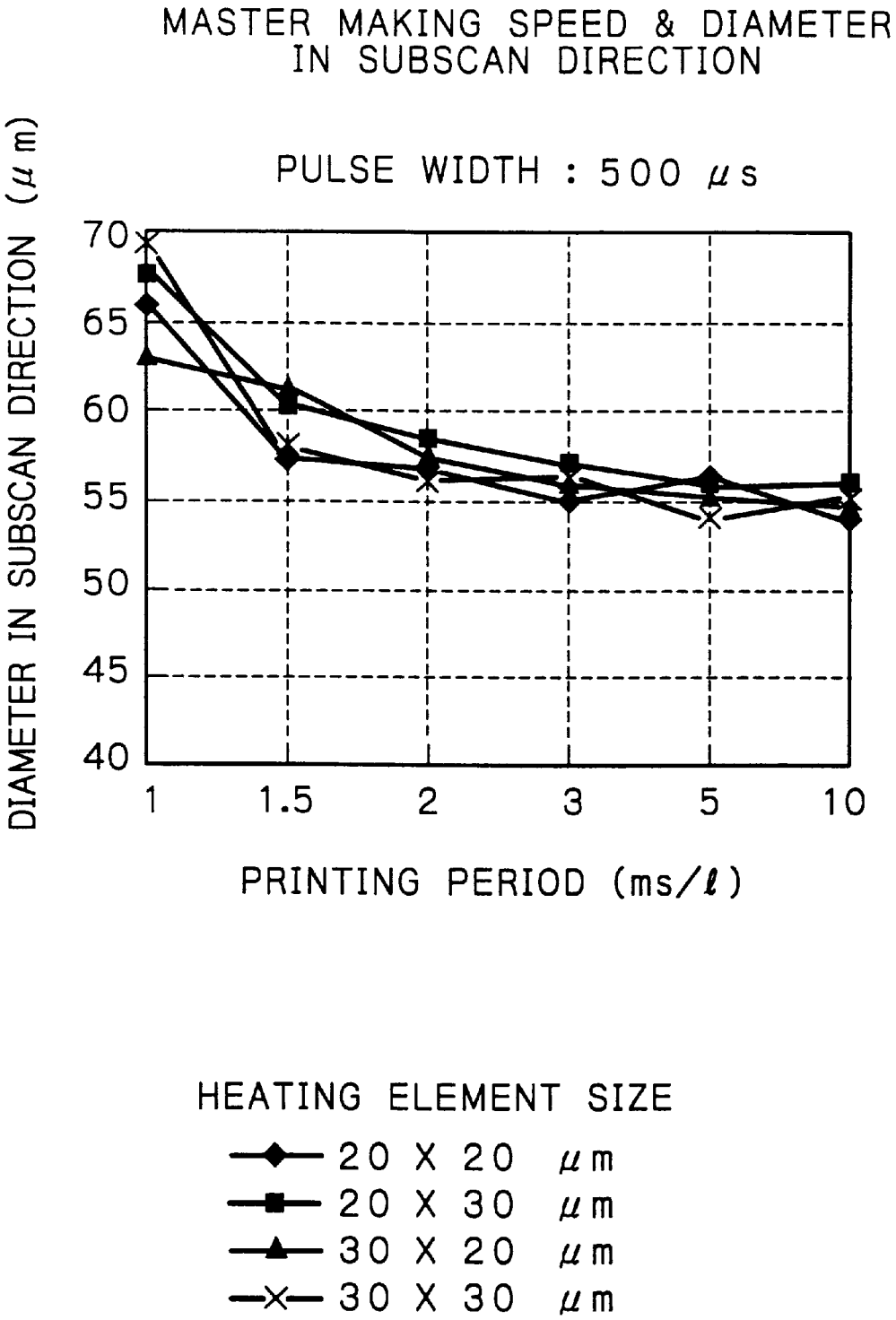
FIG. 15 is a graph similar to FIG. 14, showing a relation between the printing period and the diameter in the subscanning direction.
Figure 16:
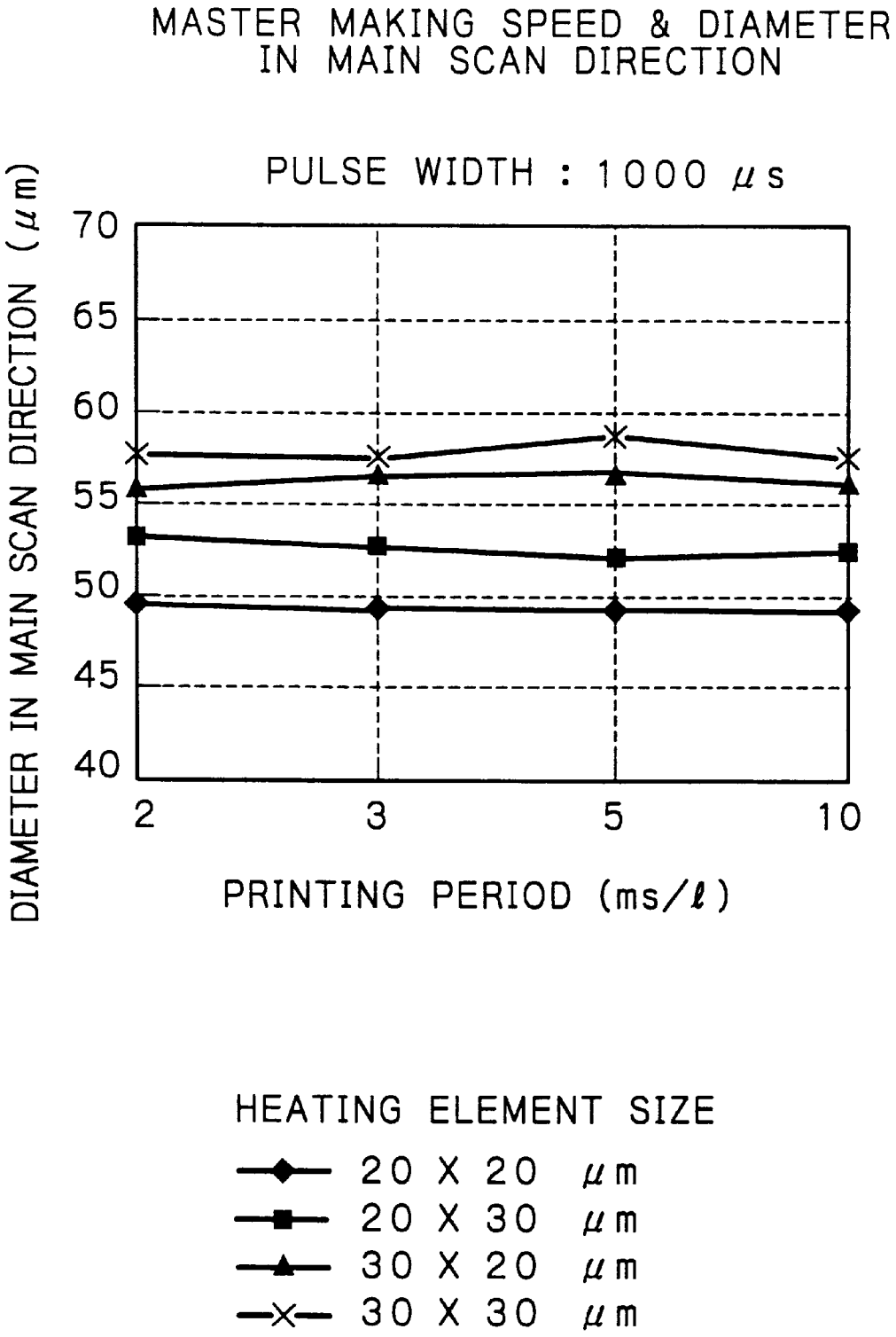
FIG. 16 is a graph showing, by using the heating element size as a parameter, a relation between the printing period and the diameter in the main scanning direction determined when the pulse width was 1,000 μs and particular to the fourth embodiment.
Figure 17:
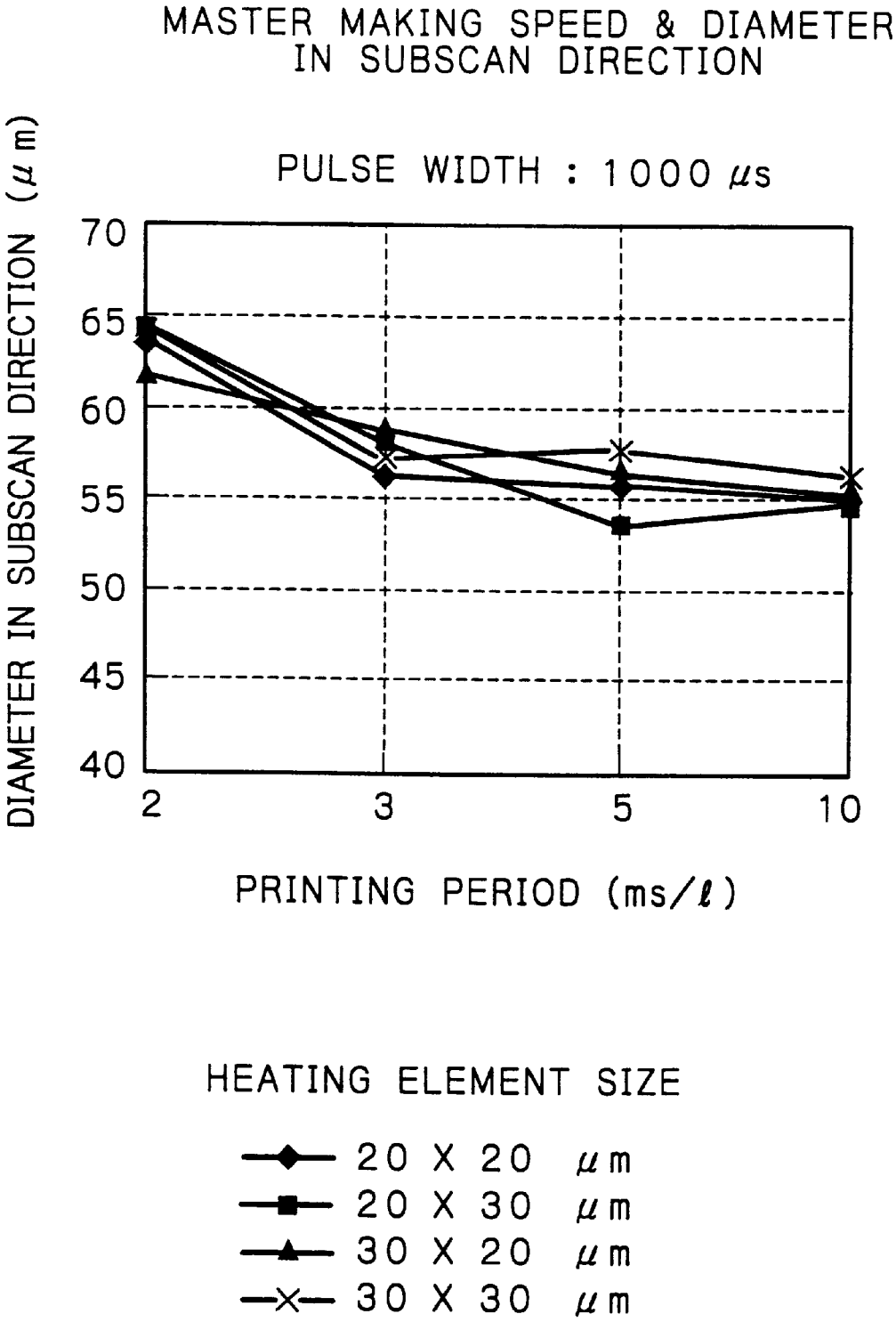
FIG. 17 is a graph similar to FIG. 16, showing a relation between the printing period and the diameter in the subscanning direction.
Figure 18:
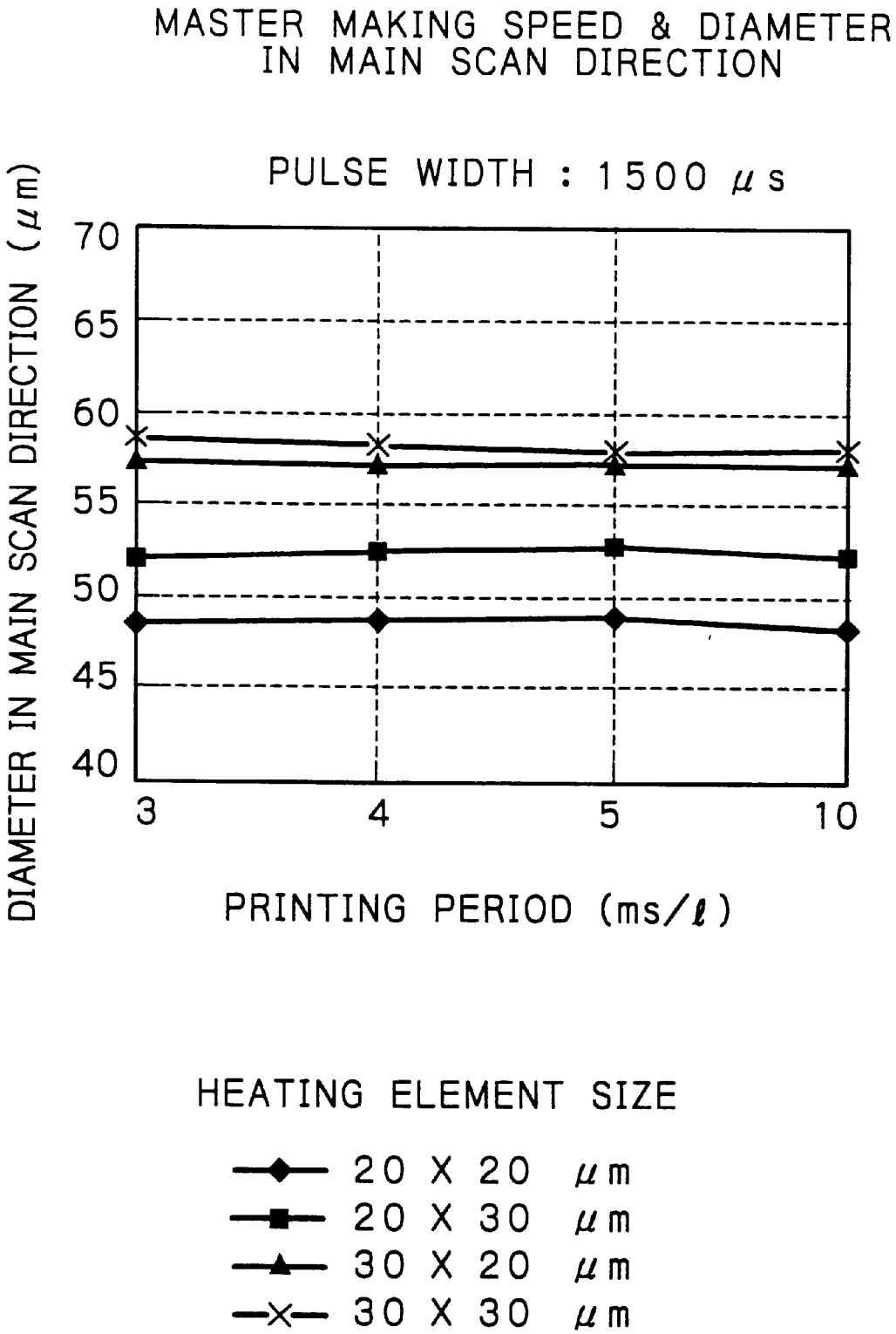
FIG. 18 is a graph showing, by using the heating element size as a parameter, a relation between the printing period and the diameter in the main scanning direction determined when the pulse width was 1,500 μs and particular to the fourth embodiment.
Figure 19:
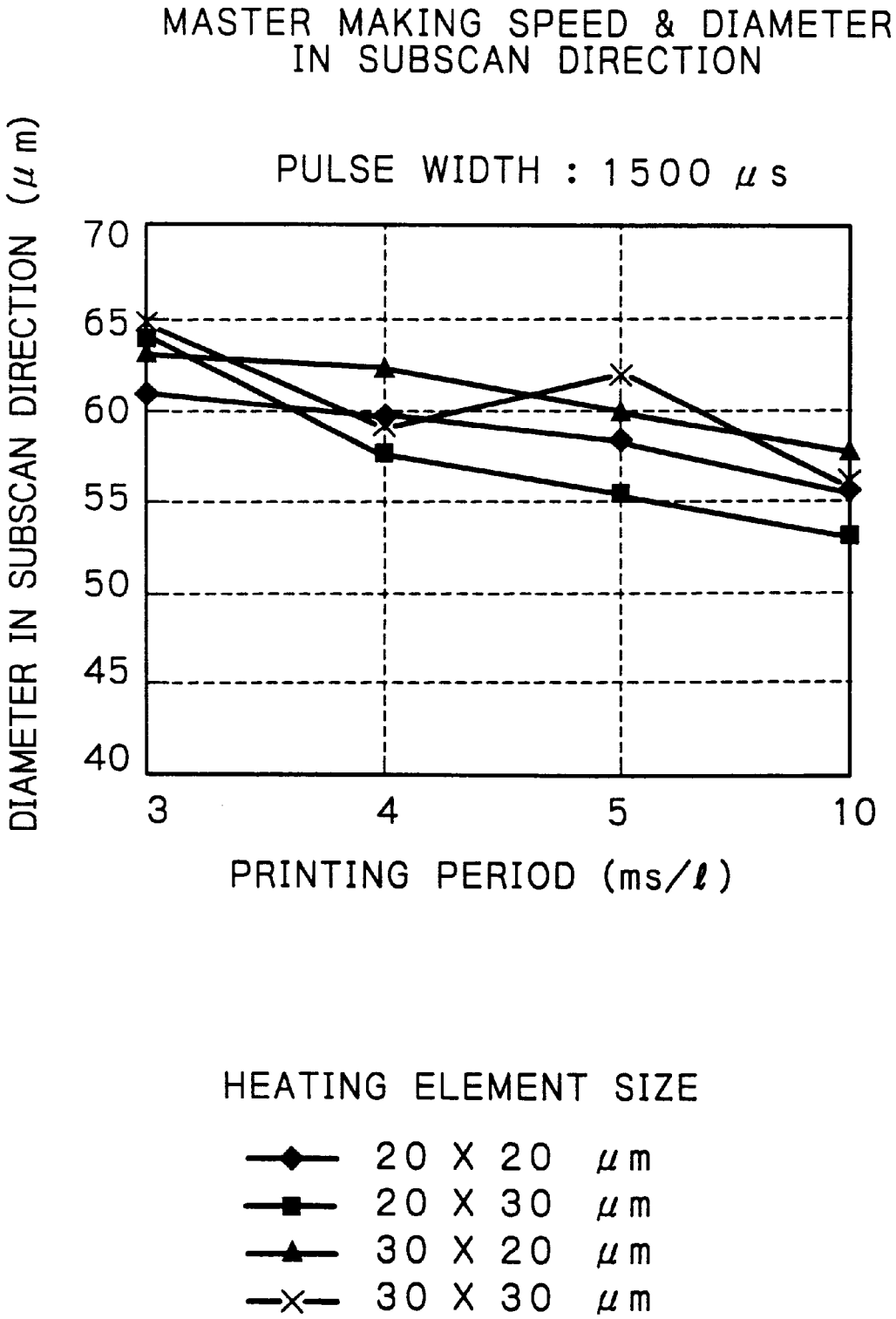
FIG. 19 is a graph similar to FIG. 18, showing a relation between the printing period and the diameter in the subscanning direction.

As FIGS. 14, 16 and 18 indicate, all the heads 1 different in heating element size provide the perforation with the substantially the same diameter Ls in the main scanning direction without regard to the printing period t1. However, as FIGS. 15, 17 and 19 show, the diameter Lf sequentially increases with a decrease in printing period t1 without regard to the heating element size. Further, when the head 1 whose heating element 2 had any one of the sizes of 20×20, 20×30 and 30×30 μm was used, the diameter Lf sharply increased as soon as the printing period t1 decreased below a certain value (1.5 ms/line).

Figure 22:
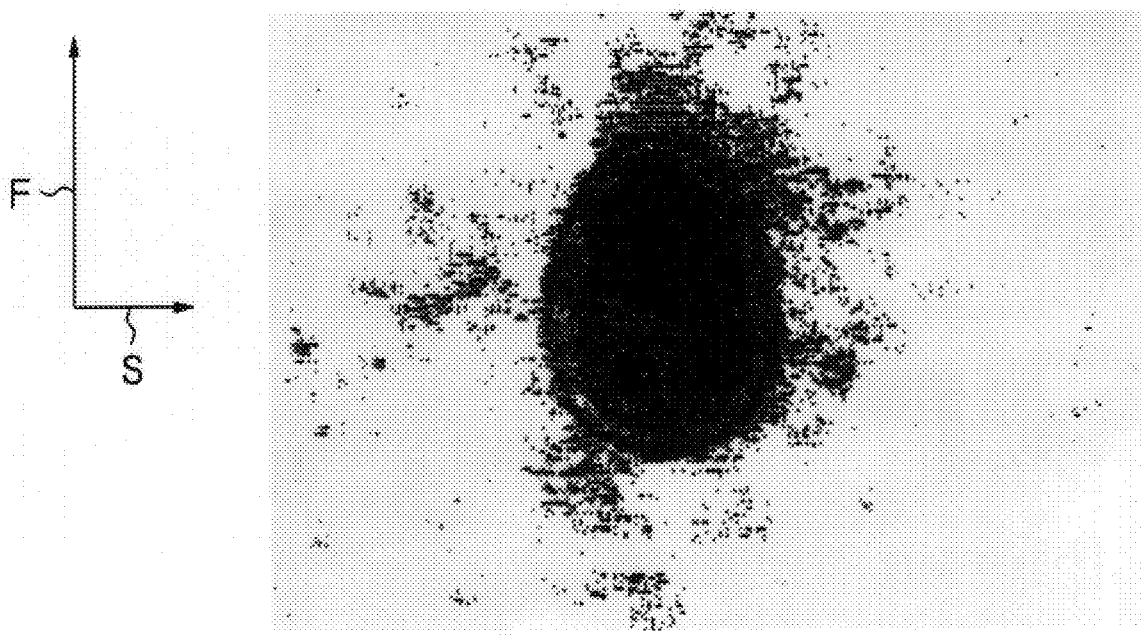
FIG. 22 shows a first photograph showing a perforation formed by the fourth embodiment when the heating element size was 20×30 μm, the pulse width was 500 μs, the energy was 49 μJ, and the printing period was 1 ms/line.

FIG. 22 shows a first photograph representative of a perforation formed in the stencil 3 by the head 1 whose heating elements 2 were sized 20×30 μm, pulse width tp of 500 s, energy Es of 49 μJ, and the printing speed t1 of 1 ms/line. In the first photograph and a third to a fifth photograph shown in FIG. 27A–27C, black portions indicate the perforation h while generally annular outline portions surrounding the perforations h indicate the banks ha.

Figure 23:
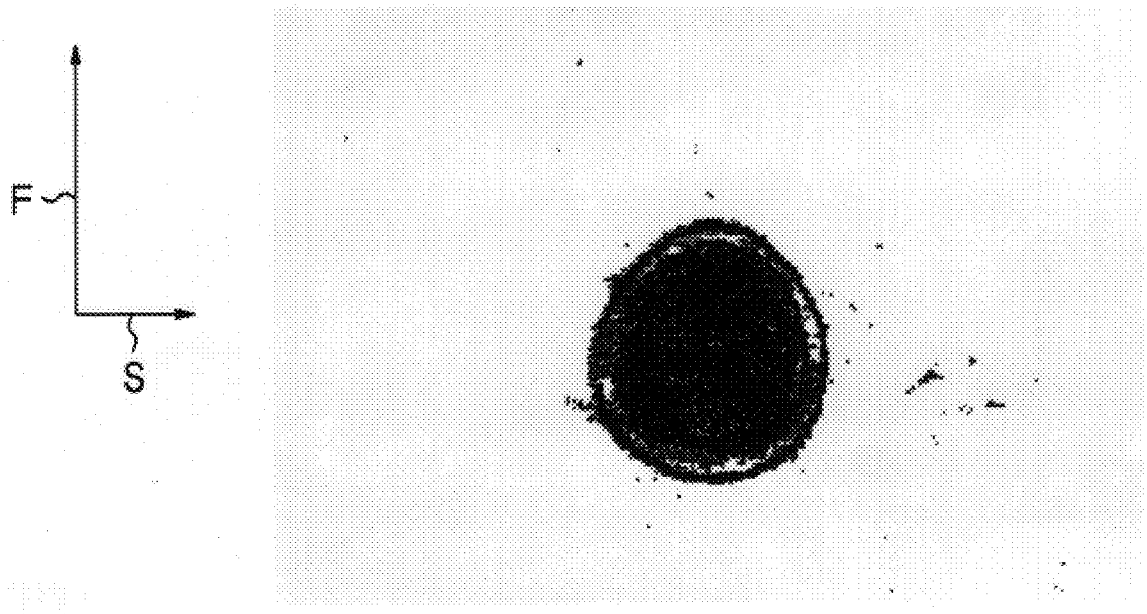
FIG. 23 shows a second photograph showing a perforation formed under the same conditions as the perforation of FIG. 22 except that the printing period was 1.5 ms/line.

FIG. 23 shows a second photograph representative of a perforation formed in the same conditions as the perforation of FIG. 22 except that the printing period t1 was 1.5 ms/line. The first photograph of FIG. 22 shows that the perforation is oblong and noticeably decreases in diameter in the main scanning direction at its downstream end in the subscanning direction F, i.e., the direction of stencil conveyance.

FIFTH EMBODIMENT

The energy Es to be applied to the heating element 2 was varied in order to increase or decrease the diameters Ls and Lf. This embodiment is identical with the first embodiment except for the following conditions.

(1) The heating element 2 was sized 20×30 μm (main scanning×subscanning).

(2) The pulse width tp was 500 μs.

(3) The energy Es was varied in three consecutive steps to 37.9, 43.1 and 48.5 μJ.

Figure 20:
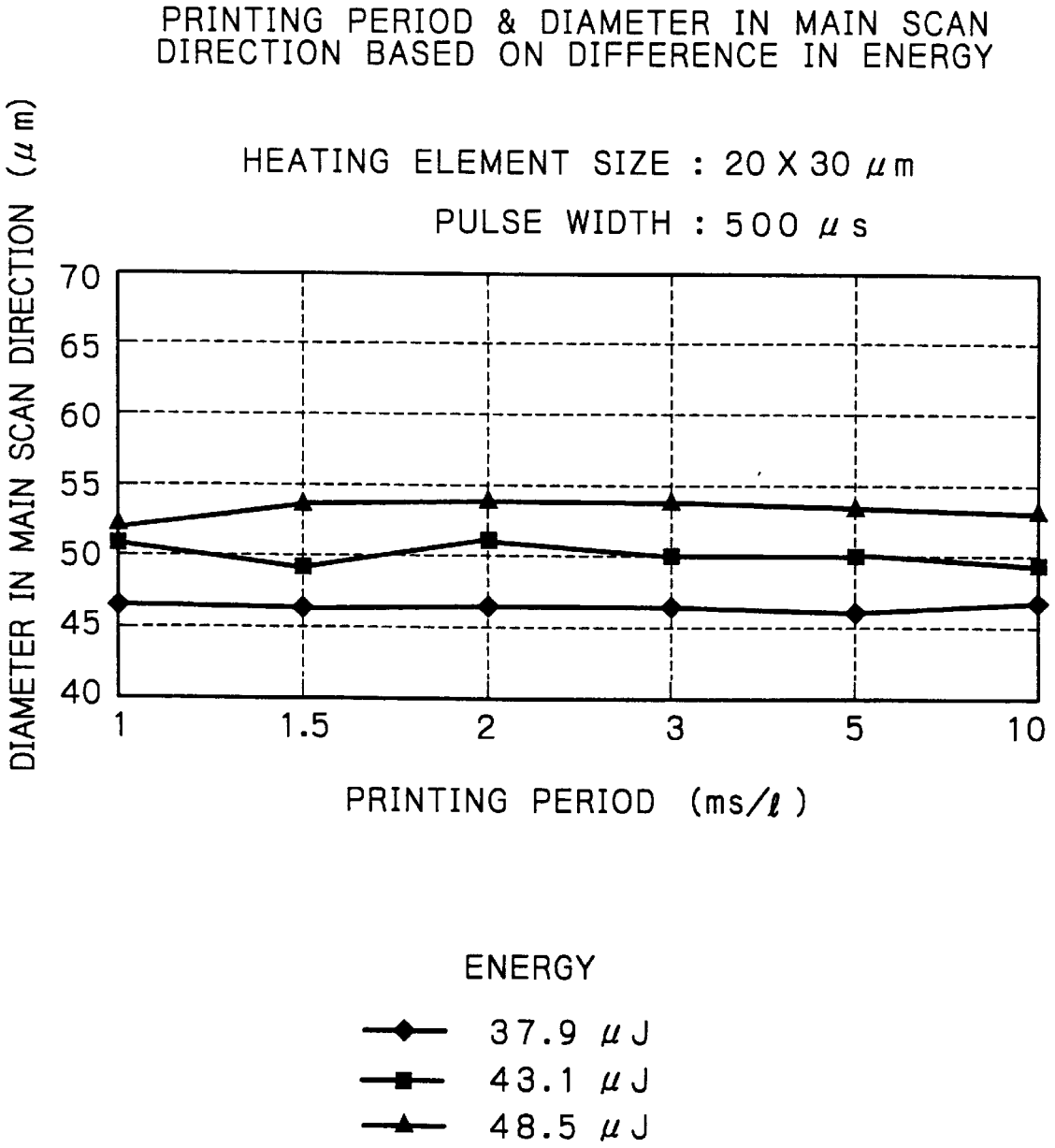
FIG. 20 is a graph showing, by using the energy as a parameter, a relation between the printing period and the diameter in the main scanning direction determined when the heating element size was 20×30 μm and the pulse width was 500 μs and representative of a fifth embodiment of the present invention.
Figure 21:
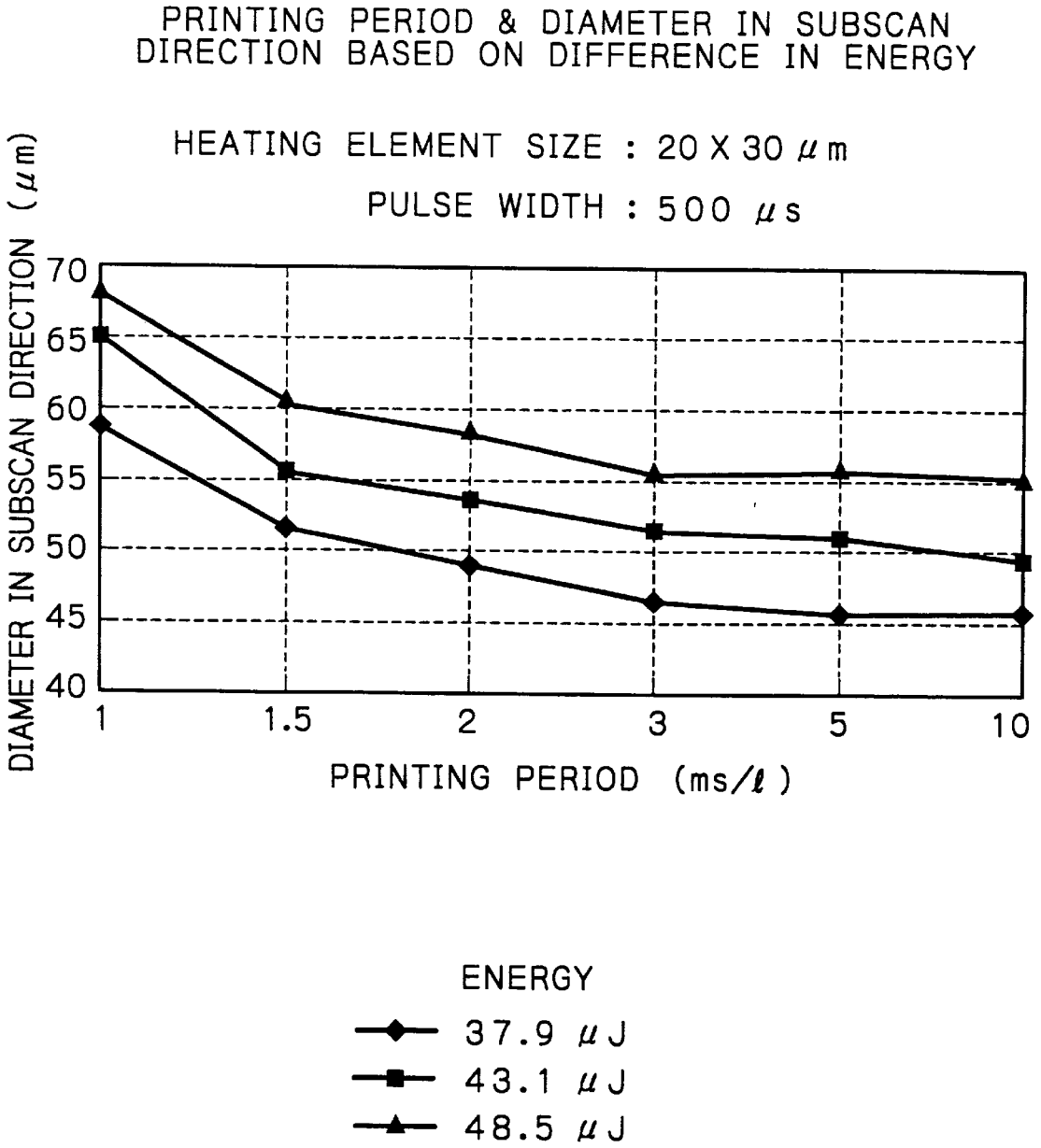
FIG. 21 is a graph similar to FIG. 20, showing a relation between the printing period and the diameter in the subscanning direction.

FIG. 20 shows a relation between the printing period or master making speed t1 and the diameter Ls with respect to the energy Es. FIG. 21 shows a relation between the printing period t1 and the diameter Lf with respect to the energy Es. In FIGS. 20 and 21, the amount of heat to be generated by the heating element 2 is varied by varying the energy Es. As shown, when the printing period t1 is relatively long, the diameters Ls and Lf are obviously dependent on the energy Es. However, the printing period t1 causing the diameter Lf to sharply increase, as found in the fourth embodiment, is 1.5 ms/line without regard to the energy Es.

On the other hand, when the heating element 2 is sized 30×20 μm, the diameter Lf does not sharply increase even when the printing period t1 decreases below a certain value. This is contrastive to the case wherein the heating element 2 is sized 20×20, 20×30 or 30×30 μm (see FIGS. 15, 17 or 19). Such a difference is presumably derived from a difference in heating temperature dependent on the configuration or size of the heating element 2.

SIXTH EMBODIMENT

How the distributions of heating temperature in the main scanning direction S and subscanning direction F vary in accordance with the size of the heating element was determined. This embodiment is identical with the first embodiment except for the following conditions for experiments. Again, the heating temperatures in the directions S and F were measured by the infrared microscope type radiothermometer.

(1) The pulse width tp was 500 μs.

Figure 24:
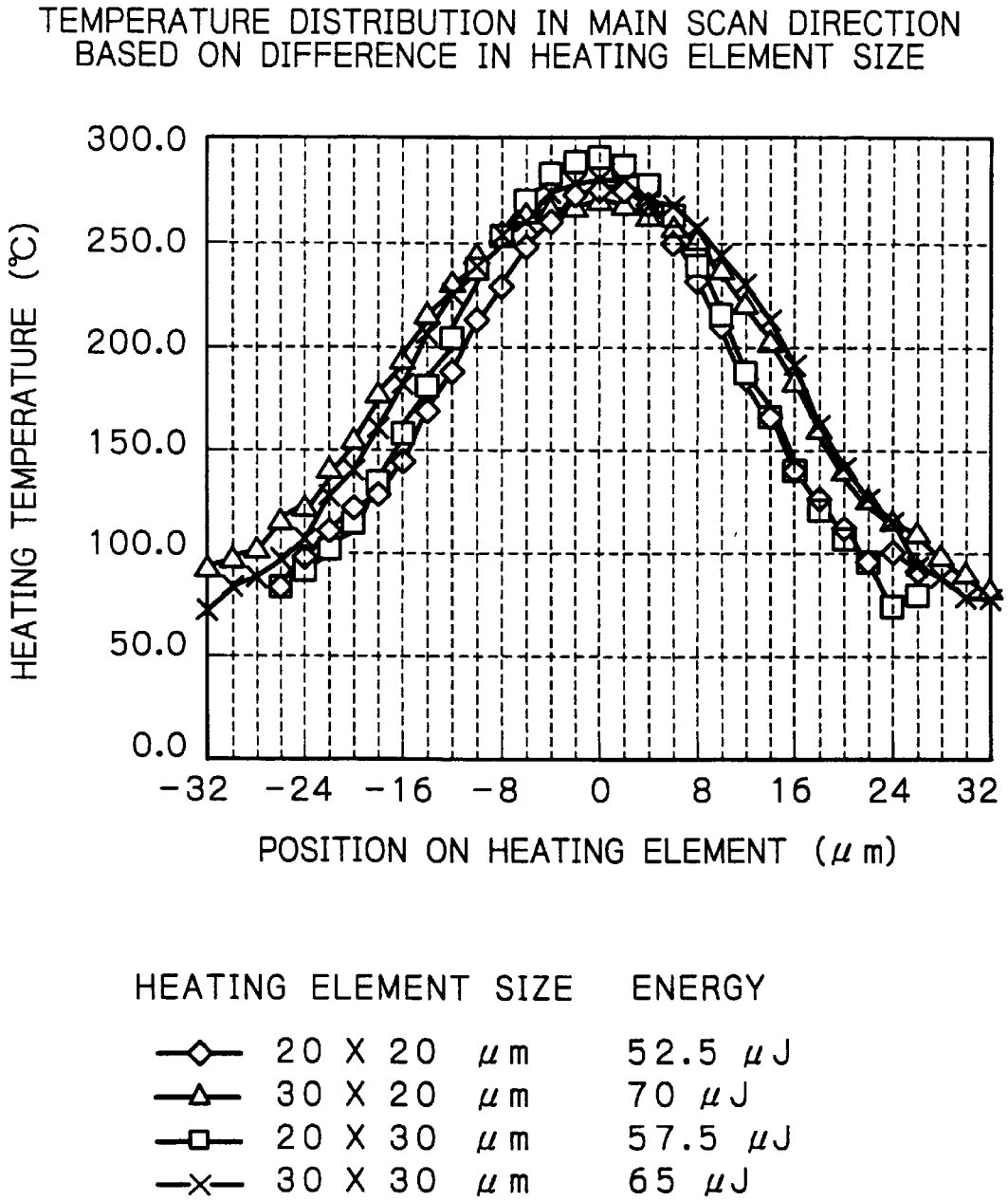
FIG. 24 is a graph showing, by using the heating element size as a parameter, a heating temperature distribution determined at positions on an imaginary line Bb of FIG. 26 extending in the main scanning direction and representative of a sixth embodiment of the present invention.
Figure 25:
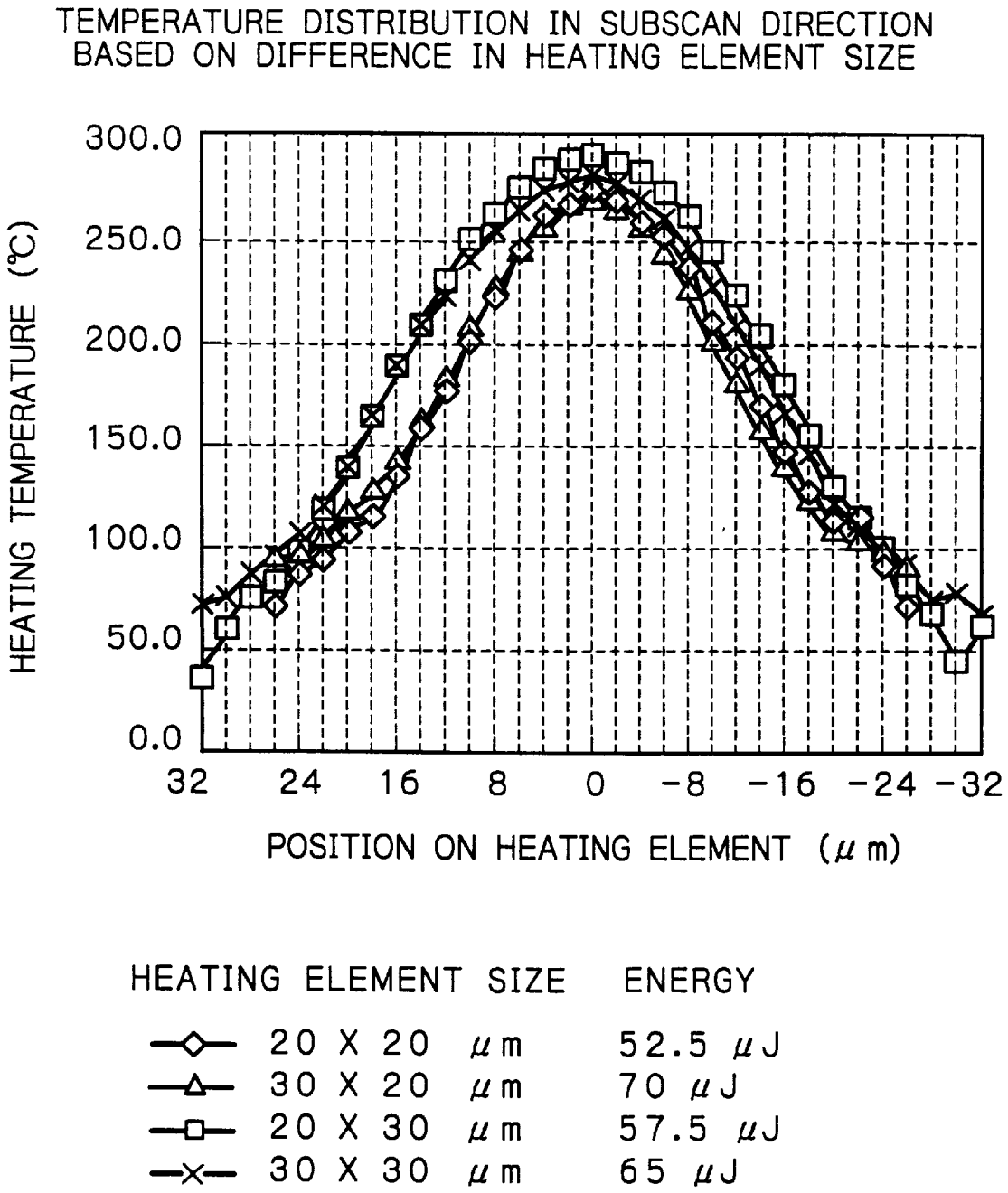
FIG. 25 is a graph similar to FIG. 24, showing a heating temperature distribution determined at positions on an imaginary line Aa of FIG. 26 extending in the subscanning direction.

(2) Particular energy Es was selected for each heating element size:
20×20 μm: 52.5 μJ
20×30 μm: 57.5 μJ
30×20 μm: 70.0 μJ
30×30 μm: 65.0 μJ FIG. 26 shows imaginary lines Bb and As extending through the individual heating element 2 in the main scanning direction S and subscanning direction F, respectively. The lines Bb and As respectively bisect the heating element 2 in the main scanning direction Sand subscanning direction F; the point 0 (zero) where the lines Bb and As intersect is the center of the heating element 2. FIGS. 26 and 27 respectively show a heating temperature distribution measured on the line Bb and a heating temperature distribution measured on the line Aa. In FIG. 24, the abscissa and ordinate respectively indicate the position on the heating element 2 in the main scanning direction S and heating temperature (°C.). In FIG. 25, the abscissa and ordinate respectively indicate the position on the heating element 2 in the subscanning direction F and heating temperature (°C.). In FIGS. 24 and 25, signs "+" and "−" correspond to directions shown in FIG. 26.

It will readily be seen from FIGS. 24 and 25 that the length of the heating temperature distribution at each position on the heating element 2 is proportional to the lengths of the element 2 in the main and subscanning directions S and F without regard to the size of the element 2. Stated another way, the width over which the heating temperature is constant increases in proportion to the width of the heating element 2. This is generally true in both of the directions S and F.

As for the heating element 2 sized 20×30 μm, the heating temperature is distributed over the same length in the main scanning direction S and subscanning direction F. As for the heating element 2 sized 20×20 or 30×30 μm, the heating temperature is distributed over a slightly greater length in the main scanning direction S than in the subscanning direction. Further, as for the heating element 2 sized 30×20 μm, the heating temperature is distributed over a far greater length in the main scanning direction S than in the subscanning direction F.

The heating element sizes of 20×30, 20×20 and 30×30 μm and the heating element size of 30×20 μm will hereinafter be compared with respect to the heating temperature distribution and the configuration of the perforation. When the printing period t1 is reduced, the amount of movement of the stencil 3 for a unit period of time in the subscanning direction F increases. The temperature of the heating element 2 begins to rise at the center (point 0, FIG. 26) and has a generally convex distribution sequentially falling in each of the main and subscanning directions S and F. When the heating element 2 reaches a certain threshold temperature for melting and perforating the film of the stencil 3, the film begins to be perforated while shrinking.

Assume the heating element 2 sized 20×20, 20×30 or 30×30 μm. Then, if the printing period t1 is short, the heating element 2 moves relative to the film of the stencil 3 at the same time as it perforates the film. As a result, at the initial stage of perforation, the film does not fully shrink although it is perforated. A perforation is presumably completed in both of the directions S and F when the heating element 2 reaches a certain high temperature in the directions S and F. Why the perforation excessively extends in the subscanning direction F, i.e., why the diameter Lf excessively increases in the direction F is presumably that the above initial part of perforation which is incomplete and the final part of perforation which is complete are combined.

By contrast, as for the heating element 2 sized 30×20 μm, the distribution of the equal temperature of the element 2 is extended in the main scanning direction S. In this condition, the amount of heat necessary for forming a complete perforation in the film is easily transferred to the film even in the direction S at the same time as the film begins to be perforated while shrinking. This is presumably why the perforation is prevented from excessively extending in the subscanning direction F.

SEVENTH EMBODIMENT

Figure 27A:
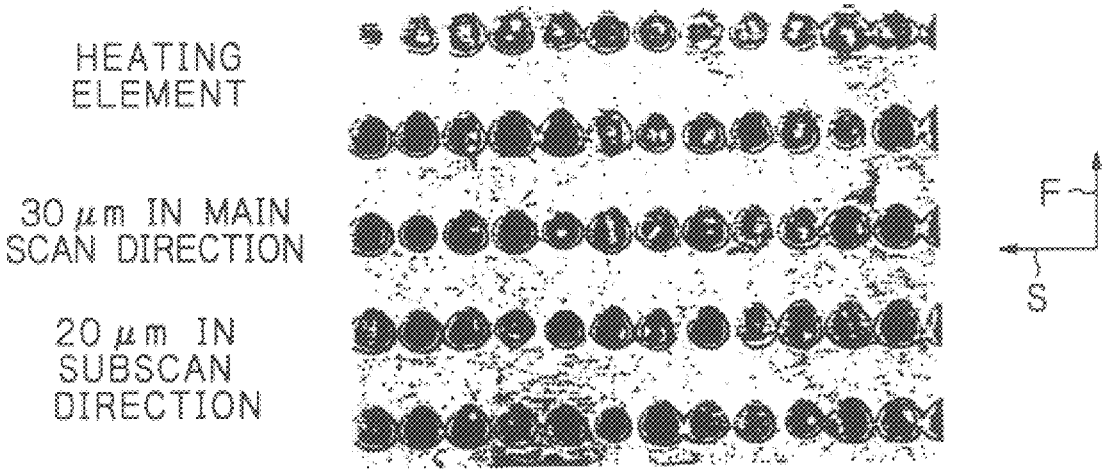
FIGS. 27A–27C respectively show a third to a fifth photograph each showing perforations formed under particular conditions and representative of a seventh embodiment of the present invention.
Figure 27B:
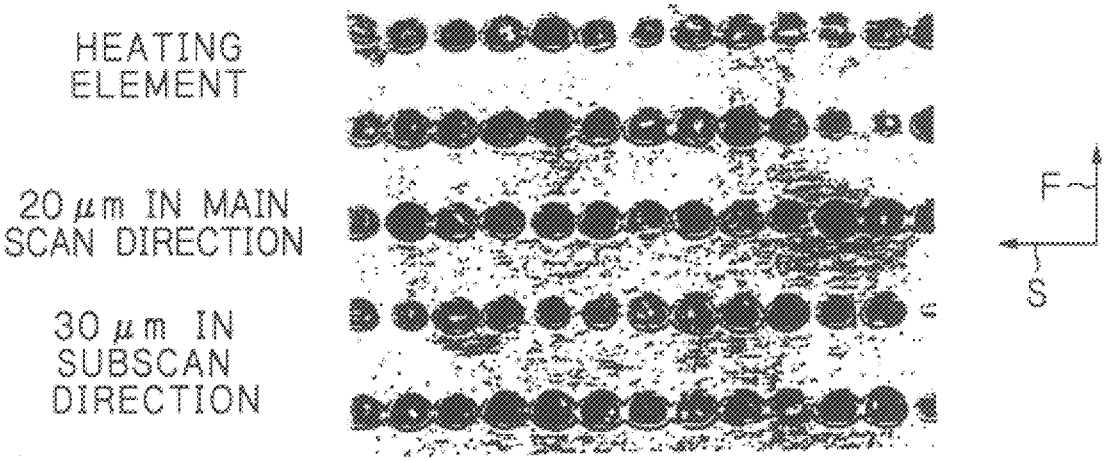
Figure 27C:
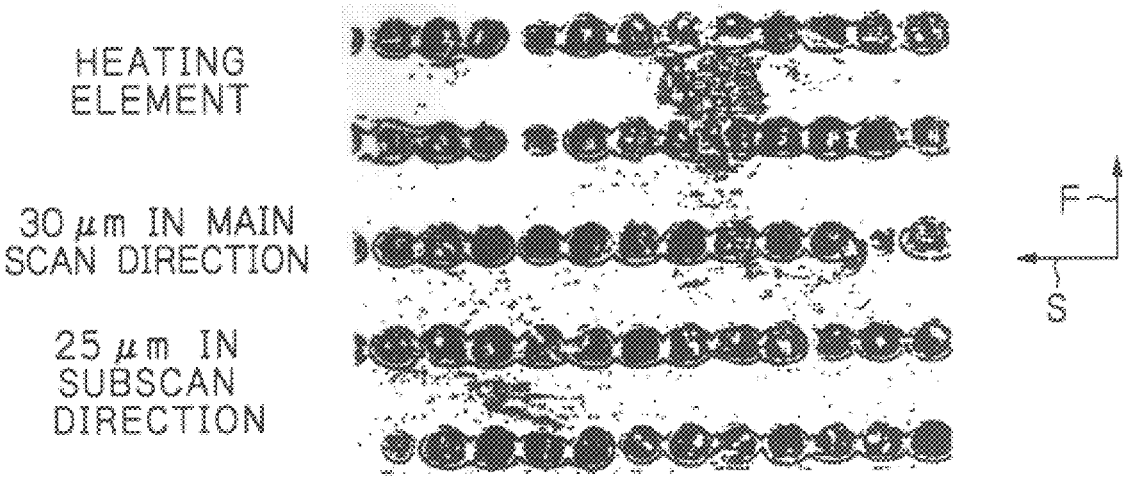

FIGS. 27A–27C respectively show the third to fifth photographs representative of experimental results proving the above phenomenon. The third to fifth photographs show perforation patterns respectively formed by the heating elements sized 20×30, 30×20 and 30×25 μm. As shown, the perforation patters each have several tens of consecutive dots in the main scanning direction S and each were formed every other line at the feed pitch pf of 63.5 m line in the subscanning direction F. This embodiment is identical with the first embodiment except for the following master making conditions.

The perforations or perforation pattern shown in FIG. 27A was formed by the heating element size of 20×30 μm, printing period t1 of 1.5 ms/line, pulse width tp of 600 μs, and energy Es of 45.5 μJ. The perforation pattern shown in FIG. 27B was formed by the heating element size of 30×20 μm, printing period t1 of 1.5 ms/line, pulse width tp of 600 μs, and energy Es of 49.0 μJ. The perforation pattern shown in FIG. 27C was formed by the heating element size of 30×25 μm, printing period t1 of 1.5 ms/line, pulse width tp of 600 μs, and energy Es of 60.0 μJ.

The specific values stated above with reference to FIGS. 27A–27C each are the limit capable of preventing the diameter of the perforation formed by the heating element sized 20×30, 30×20 or 30×25 μm, respectively, from excessively increasing in the subscanning direction F. It will be seen that the perforation h formed by the heating element 2 sized 20×30 μm has, even at the beginning thereof, a triangular configuration with short shrinkage in the main scanning direction S. This proves that the speed at which the stencil 3 moves along the heating elements 2 is too high for its film to fully shrink in the main scanning direction S at the beginning of perforation although it is perforated. That is, the shrinkage of the film stops halfway.

By contrast, the perforations h formed by the heating elements 2 sized 30×25 and 30×20 μm each have a minimum of triangular configuration ascribable to short shrinkage at the beginning thereof.

The excessive extension of the diameter Lf in the subscanning direction F obstructs the independence of the individual perforation h in the direction F and causes, in the worst case, nearby perforations h to join each other in the direction F, thereby degrading image quality. Although the diameter Lf may not be extended to such a degree, the triangular configuration with short shrinkage occurring at the beginning of each perforation h in the main scanning direction S is not desirable because ink to be transferred to a paper via the perforation is dependent on the configuration of the perforation h.

EIGHTH EMBODIMENT

Again, use was made of the heads 1 respectively having the heating elements 2 sized 20×20, 20×30 and 30×30 μm. How the printing period t1, pulse width tp and distance by which the stencil 3 is conveyed over the pulse width tp are related was determined at a point where the diameter Lf in the subscanning direction F excessively increases and the diameter Ls in the main scanning direction decreases at the downstream end in the direction F. FIG. 30 shows Table 3 listing experimental results derived from the data listed in FIGS. 15, 17 and 19. The distance by which the stencil 3 is conveyed over the pulse width tp is produced by:

$$\text{distance}=[\text{tp}(\mu\text{s})/\text{t}\mathbf{1}(\mu\text{s/line})]\times\text{pf}(\mu\text{m/line})$$

As Table 3 and FIGS. 15, 17 and 19 indicate, when the ratio of the pulse width tp to the printing period t1 exceeds 30% and when the above distance exceeds 20 μm to 25 μm, the diameter Lf in the subscanning direction F is disturbed.

The experimental results described above show that a stable perforation free from the excessive extension of the diameter Lf is achievable without regard to the heating element size if the pulse width tp, printing period t1 and feed pitch pf satisfy a relation:

$$[\text{tp}(\mu\text{s})/\text{t}\mathbf{1}(\mu\text{s/line})]\times\text{pf}(\mu\text{m/line})\leqq 25(\mu\text{m}) \quad (1)$$

However, for a given heating element size, the pulse with tp should preferably be as long as possible for lowering the peak heating temperature of the head 1. This is successful to reduce the thermal stress to act on the heating element 2 and therefore to extend the life of the heating element, as stated earlier in relation to the second embodiment.

When the heating element 2 is sized 20×20, 20×30 or 30×30 μm, the upper limit of the pulse width tp for causing the heating element 2 to heat is limited by the above relation (1). On the other hand, when the heating element 2 is sized 30×20 μm, the diameter Lf does not sharply increase even when the printing period t1 decreases below a certain value, as stated previously in relation to the fifth embodiment. It follows that even when the printing period t1 is reduced, the maximum pulse width tp allowing the heating element 2 to heat without degrading perforation quality is also achievable if the following relation is satisfied:

$$[\text{tp}(\mu\text{s})/\text{t}\mathbf{1}(\mu\text{s/line})]\times\text{pf}(\mu\text{m/line})\geqq 25(\mu\text{m}) \quad (2)$$

The above relation (2) is therefore preferable to increase the pulse width tp as far as possible and to extend the life of the heating element 2. In practice, however, power that should be fed to the head 1 can be further reduced when the heating elements 2 arranged in an array in the main scanning direction S are driven on a time division basis in the direction S. Therefore, the heating elements 2 should be divided into at least two groups as to the time division drive. In this case, the upper limit of the pulse width tp in the above relation (2) should satisfy a relation:

$$\text{tp}(\mu\text{s})\leqq\text{t}\mathbf{1}(\mu\text{s/line})\div\text{number of groups} \quad (3)$$

where the number of groups is 2.

Generally, various kinds of correction including head temperature correction and perforation diameter control are conventional with a master making device. For this purpose, the duration of power feed to the heating elements of a thermal head is controlled. In such a case, the maximum duration of power feed at the time of correction is selected as the pulse width tp.

For comparison, experiments were conducted with thermal heads 1 whose heating elements 2 were respectively sized 50×60, 30×40 and 50×40 μm (main scanning× subscanning). That is, each heating element 2 had a length greater than one-half of the feed pitch pf (63.5 μm) in the subscanning direction F. The heads 1 each were used to continuously form a solid image in a stencil in the subscanning direction F at a printing period t1 of less than 2.5 ms/line inclusive. The experiments showed that nearby perforations were prevented from being isolated when the printing period t1 was lowered to about 2.0 ms/line.

However, when the length of the individual heating element 2 in the subscanning direction F was less than one-half of the feed pitch pf, nearby perforations were successfully isolated from each other in the direction F even when the printing period t1 was lower than 2 ms/line.

Also, when the heating element 2 is provided with a length in the main scanning direction S greater than the length in the subscanning direction F, it achieves a greater area than, e.g., the element 2 having the same length in the direction F, but having a length in the direction S smaller than the length in the direction F. This reduces the thermal stress to act on the heating element 2 and thereby extends the life of the element 2.

In the illustrative embodiments shown and described, the pitch As of the heating elements 2 in the main scanning direction S and the feed pitch pf in the subscanning direction F are substantially equal to each other. Alternatively, for the pitch As of 63.5 μm (400 dpi) by way of example, the pitch pf may be selected to be 42.3 μm (600 dpi) in order to increase the resolution in the subscanning direction F.

As stated above, in the illustrative embodiments, the heating elements 2 each have a length in the subscanning direction F smaller than one-half of the feed pitch pf in the direction F inclusive. In addition, each heating element 2 has a length in the main scanning direction S greater than the length in the subscanning direction F. Even when the master making speed is increased, i.e., even when the printing period t1 is reduced, the heating elements 2 with the above configuration can stably form optimal perforations in the stencil 3. This reduces offset and allows a minimum of fibers to exist in perforations when the stencil 3 is of the type having a porous base, insuring an optimal image with a minimum of fiber marks. Further, the heating elements 2 are caused to heat to a minimum necessary temperature in order to reduce a thermal stress to act on the elements 2. This is successful to extend the life of the heating elements 2, i.e., the life of the head 1 and to further reduce the master making time for implementing a high-speed master making procedure.

In summary, it will be seen that the present invention provides a thermal master making device having various unprecedented advantages, as enumerated below.

(1) Heating elements included in a thermal head each have a length in the subscanning direction smaller than one-half of a feed pitch in the same direction inclusive. In addition, each heating element has a length in the main scanning direction greater than the length in the subscanning direction. This prevents the diameter of a perforation from excessively increasing in the subscanning direction and allows an optimal perforation to be stably formed. As a result, offset is reduced, and an optimal image with a minimum of fiber marks is achievable even when use is made of a stencil of the kind having a porous base. In addition, the master making period can be reduced in order to implement high-speed master making.

(2) A pulse width for energizing the heating elements, a printing period assigned to the head and a feed pitch in the subscanning direction satisfy a relation:

$$[\text{pulse width}(\mu s) \div \text{printing period}(\mu s/\text{line})] \times \text{feed pitch}(\mu m/\text{line}) \geqq 25(\mu m)$$

It is therefore possible to cause the heating elements to heat to a minimum necessary temperature in order to reduce a thermal stress to act on the elements. This is successful to extend the life of the heating elements, i.e., the life of the head.

(3) The printing period is selected to be less than 2 ms/line inclusive, so that the master making time is further reduced.

(4) With the above relation between the pulse width, printing period and feed pitch, it is possible to select an optimal pulse width and therefore to form stable perforations in a thermoplastic resin film included in the stencil. In addition, the peak heating temperature of the heating elements can be lowered in order to extend the life of the elements.

Various modifications will become possible for those skilled in the art after receiving the teachings of the present disclosure without departing from the scope thereof.

What is claimed is:

1. In a thermal master making device including a thermal head having a plurality of heating elements arranged in an array in a main scanning direction, causing said thermal head to contact a stencil including a thermoplastic resin film, feeding said master at a preselected feed pitch in a subscanning direction perpendicular to the main scanning direction, and causing said plurality of heating elements to selectively heat to perforate said thermoplastic resin film in accordance with image data for thereby forming an image in said stencil in a form of a dot pattern, a pitch at which said plurality of heating elements are arranged and said feed pitch are substantially equal to each other, and said plurality of heating elements each have a length in the subscanning direction smaller than one-half of said feed pitch inclusive and have a length in the main scanning direction greater than said length in the subscanning direction.

2. A device as claimed in claim 1, wherein a pulse width for causing said heating elements to heat, a printing period of said thermal head and the feed pitch satisfy a relation:

$$[\text{pulse width}(\mu s) \div \text{printing period}(\mu s/\text{line})] \times \text{feed pitch}(\mu m/\text{line}) \geqq 25(\mu m).$$

3. A device as claimed in claim 2, wherein the printing period is less than 2 ms/line inclusive.

4. In a thermal master making device including a thermal head having a plurality of heating elements arranged in an array in a main scanning direction, causing said thermal head to contact a stencil including a thermoplastic resin film, feeding said master at a preselected feed pitch in a subscanning direction perpendicular to the main scanning direction, and causing said plurality of heating elements to selectively heat to perforate said thermoplastic resin film in accordance with image data for thereby forming an image in said stencil in a form of a dot pattern, a pitch at which said plurality of heating elements are arranged and said feed pitch are substantially equal to each other, said plurality of heating elements each have a length in the subscanning direction smaller than one-half of said feed pitch inclusive and have a length in the main scanning direction greater than said length in the subscanning direction, and a pulse width for causing said heating elements to heat, a printing period of said thermal head and said feed pitch satisfy a relation:

$$[\text{pulse width}(\mu s) \div \text{printing period}(\mu s/\text{line})] \times \text{feed pitch}(\mu m/\text{line}) \geqq 25(\mu m).$$

5. A device as claimed in claim 4, wherein the printing period is less than 2 ms/line inclusive.

6. In a thermal master making device including a thermal head having a plurality of heating elements arranged in an array in a main scanning direction, causing said thermal head to contact a stencil including a thermoplastic resin film, feeding said master at a preselected feed pitch in a subscanning direction perpendicular to the main scanning direction, and causing said plurality of heating elements to selectively heat to perforate said thermoplastic resin film in accordance with image data for thereby forming an image in said stencil in a form of a dot pattern, a pulse width for causing said heating elements to heat, a printing period of said thermal head and said feed pitch satisfy a relation:

$$[\text{pulse width}(\mu s) \div \text{printing period}(\mu s/\text{line})] \times \text{feed pitch}(\mu m/\text{line}) \leqq 25(\mu m).$$

* * * * *